US005451706A

United States Patent [19]

Yamamoto et al.

[11] Patent Number: 5,451,706

[45] Date of Patent: Sep. 19, 1995

[54] AUTOMATIC PLAYER PIANO EQUIPPED WITH MUTE LOCK SYSTEM FOR REPRODUCING FAINT SOUNDS IN PLAYBACK MODE

[75] Inventors: Jun Yamamoto; Shinya Koseki, both of Shizuoka, Japan

[73] Assignee: Yamaha Corporation, Japan

[21] Appl. No.: 13,614

[22] Filed: Feb. 4, 1993

[30] Foreign Application Priority Data

| | | | |
|---|---|---|---|
| Feb. 14, 1992 | [JP] | Japan | 4-028510 |
| Aug. 28, 1992 | [JP] | Japan | 4-230603 |
| Aug. 31, 1992 | [JP] | Japan | 4-232491 |
| Aug. 31, 1992 | [JP] | Japan | 4-232492 |

[51] Int. Cl.[6] ..... G10F 1/02; G10C 3/26

[52] U.S. Cl. ..... 84/34; 84/21; 84/221

[58] Field of Search ..... 84/216–221, 84/225, 226, 20, 21, 34

[56] References Cited

U.S. PATENT DOCUMENTS

| | | | |
|---|---|---|---|
| 762,489 | 6/1904 | Norris . | |
| 901,906 | 10/1908 | Ives . | |
| 945,850 | 1/1910 | Mayer . | |
| 954,043 | 4/1910 | Norcross . | |
| 4,756,223 | 7/1988 | Murakami | 84/226 X |
| 4,924,742 | 5/1990 | Numata et al. . | |
| 5,335,574 | 8/1994 | Matsunaga et al. | 84/21 |

*Primary Examiner*—William M. Shoop, Jr.
*Assistant Examiner*—Jeffrey W. Donels
*Attorney, Agent, or Firm*—Graham & James

[57] ABSTRACT

An automatic player piano largely comprises mechanical components such as a keyboard, key action mechanisms, hammer mechanisms, damper mechanisms and pedal mechanisms and electrical components such as solenoid operated actuators associated with the keyboard and the pedal mechanism, a controller and sensors, and the pedal mechanism for a soft pedal is further associated with a mute lock mechanism so that the pedal mechanism can cause the hammers closer to the associated music wires for producing faint sounds.

4 Claims, 19 Drawing Sheets

AUTOMATIC PLAYER PIANO EQUIPPED WITH MUTE LOCK SYSTEM FOR REPRODUCING FAINT SOUNDS IN PLAYBACK MODE

FIELD OF THE INVENTION

This invention relates to an automatic player piano and, more particularly, to an interlock system for faint sounds.

DESCRIPTION OF THE RELATED ART

An automatic player piano is responsive not only to a keying-in operation on the keyboard but also to digital music data codes, and produces or reproduces music. Namely, if the player performs music, the keys on the keyboard is sequentially depressed in accordance with a music score, and the key action mechanisms drive the associated hammers for striking the associated music wires. While sequentially depressing the keys on the keyboard, the player may step on a damper pedal, and the automatic player piano allows the damper felt to keep off for prolonging sounds. If the player steps on a soft pedal, the automatic player piano makes the hammers closer to the associated music wires, and the hammers associated with the depressed keys strike the music wires with smaller forces for lessening the volumes of the sounds. Thus, the automatic player piano in the ordinary playing mode is analogous to an acoustic piano.

On the other hand, if the automatic player piano enters a playback mode, digital music data codes are sequentially retrieved, and actuators selectively drive the key action mechanisms for sequentially striking the music wires. The damper and soft pedal mechanisms are also driven by associated actuators in the playback mode, and the same musical effects are imparted to the sounds.

FIG. 1 illustrates a typical example of the pedal mechanism incorporated in the automatic player piano, and the pedal mechanism is mounted on a bottom plate 1. The pedal mechanism comprises a pedal 2 pivotally supported by a bracket 3, and the pedal 2 is connected to one end of a pole 4 by means of a bolt 5*a* and a nut 5*b*. The pole is rotatably supported by a bracket 6, and the other end of the pole 4 is connected to a pedal rod 7. A spring 8 is connected between the pole 4 and the bracket 6, and urges the pole 4 in the clockwise direction. Though not shown in FIG. 1, the pedal rod 7 is coupled with a damper assembly or a hammer assembly. When a player steps on the pedal 2, the pole 4 is driven for rotation in the counter clockwise direction, and the damper assembly or the hammer assembly behaves as described hereinbefore so as to impart the aforesaid musical effect in the ordinary playing mode. For the playback mode of operation, a solenoid operated actuator 9 is further coupled through a wire 10 with the pole 4, and the solenoid operated actuator 9 pulls up the wire 10 for actuating the damper assembly or the hammer assembly when energized. The pedal mechanism shown in FIG. 1 is similar to the mechanism disclosed in Japanese Utility Model Registration Application No. 62-142096.

Another pedal mechanism incorporated in an automatic player piano is disclosed in Japanese Utility Model Registration Application laid-open (Kokai) No. 58-118489, and an actuator is coupled with a pole by means of a hook member.

However, the soft pedal mechanism incorporated in the automatic player piano tends to disturb the rhythm of a music reproduced in the playback mode of operation, and the automatic player piano hardly reproduces sounds with extremely small volume. A background music is usually provided in extremely small volume, and the prior art automatic player piano is weak in the background music.

In order to overcome the drawback, a mute mechanism is proposed and disclosed in Japanese Patent Application laid-open No. 2-48696, and forms a part of the automatic player piano. The automatic player piano is equipped with the soft pedal mechanism, and the mute mechanism is added thereto. The mute mechanism comprises a geared motor coupled through a wire with a hammer rail. When the automatic player piano is requested to reproduce a background music, the geared motor takes up the wire, and, accordingly, drives the hammer rail for rotation toward the music wires. As a result, the hammers are moved to positions closer to the associated music wires than those moved upon manipulation of the soft pedal, and softly strike the music wires, thereby reproducing faint sounds for the background music.

As described hereinbefore, the pedal mechanism can not reproduce faint sounds. Additionally, the solenoid operated actuator 9 is expected to urge the pole 4 against the spring 8, and force produced by the solenoid is partially consumed for deformation of the wire 10 or the hook due to difference between the motion of the pole 4 and the motion of the wire 10 or the hook. This means that a large sized solenoid is necessary for the pedal mechanism.

Moreover, the solenoid operated actuator 9 should be installed just over the pole 4 without disturbance of the motion of the pedal rod 7, and the space design is not flexible.

Furthermore, the motion of the pedal rod or the pole should be monitored by sensors so as to control the solenoid operated actuator 9, and the monitoring sensors are periodically readjusted to appropriate positions. This means that the prior art automatic player piano is poor in maintainability.

Finally, if the wire 10 is too long or too short to be coupled with the pole 4, the long or short wire 10 is changed to another wire, and the wire 10 is not easily adjustable. This means that an assembly work consumes time and labor.

Even if the mute mechanism is equipped, most of the problems are left. Moreover, the mute mechanism per se is origin of other troubles. Namely, when a player steps on the soft pedal, the hammer rail is moved toward the music wires, and the wire coupled with the geared motor is loosened. The loose wire tends to be caught in another component, and malfunction takes place.

The geared motor is noisy, and is undesirable for an musical instrument.

The motion of the hammer rail should be also monitored by sensors for controlling the geared motor. The sensors are independent from the sensors associated with the soft pedal mechanism, and the automatic player piano becomes complex.

Even if the solenoid operated actuator slightly drives the hammer rail in the playback mode of operation, the mute mechanism may cancel the motion of the solenoid operated actuator, and the music is not exactly reproduced.

Finally, if the volume is changed immediately before repetition of keys, the mute mechanism can not quickly respond to the change of volume.

SUMMARY OF THE INVENTION

It is therefore an important object of the present invention to provide an automatic player piano which is free from the problems inherent in the prior art automatic player pianos.

To accomplish the object, the present invention proposes to cause an actuator associated with a pedal mechanism for a soft pedal to lock in a position where an associated pedal mechanism causes hammers to keep in a closer position to music wires.

In accordance with the present invention, there is provided an automatic player piano comprising: a) a keyboard having a plurality of keys each swingable when a player depressed; b) a plurality of key action mechanisms respectively coupled with the keys, and starting motions when the player depresses the associated keys; c) a plurality of hammer mechanisms respectively coupled with the plurality of key action mechanisms, and having respective hammers selectively driven by the associated key action mechanisms for striking associated music wires, and a hammer rail causing the hammers to move between a closer position to the associated music wires and a spaced position from the associated music wires; d) a soft pedal mechanism having a soft pedal depressed by the player, and a pedal mechanism responsive to motion of the soft pedal and operative to drive the hammer rail for causing the hammers to move to the closer position; e) a playback means operative to cause the hammer mechanisms to selectively strike the associated music wires for reproducing sounds without the player; f) an actuator selectively entering a first state and a second state, and operative to drive the pedal mechanism for causing the hammers to move between the closer position and the spaced position; and g) a mute lock means provided in association with the actuator, and operative to keep the actuator in the second state for keeping the hammers in the closer position.

BRIEF DESCRIPTION OF THE DRAWINGS

The features and advantages of the automatic player piano according to the present invention will be more clearly understood from the following description taken in conjunction with the accompanying drawings in which.

DESCRIPTION OF THE PREFERRED EMBODIMENTS

First Embodiment

Figure 1:
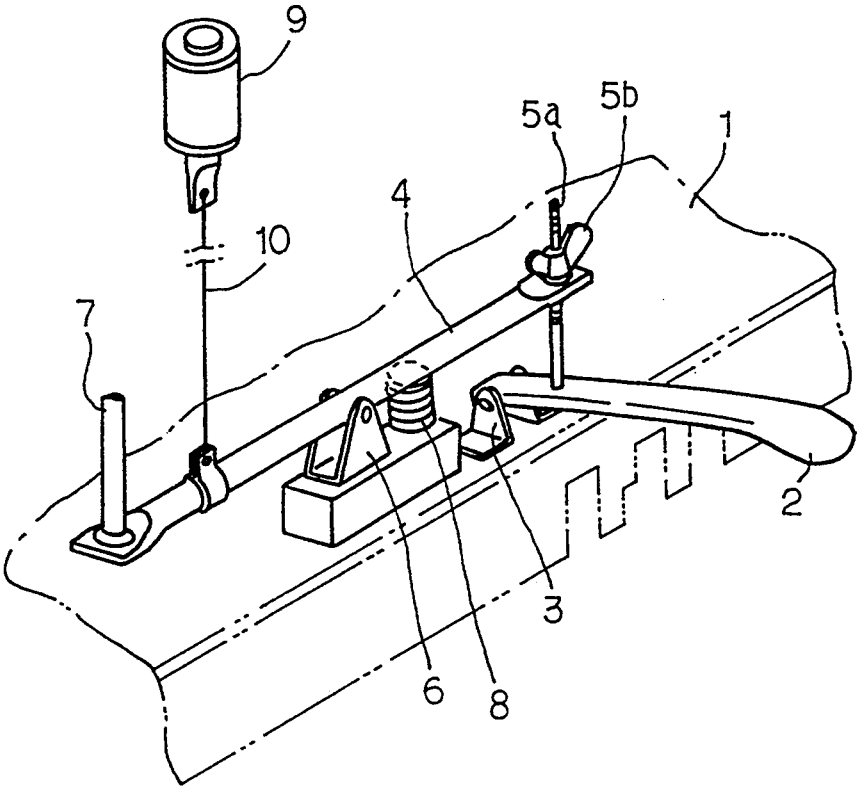
Fig.1 PRIOR ART
FIG. 1 is a perspective view showing the pedal mechanism incorporated in the prior art automatic player piano.
Figure 2:
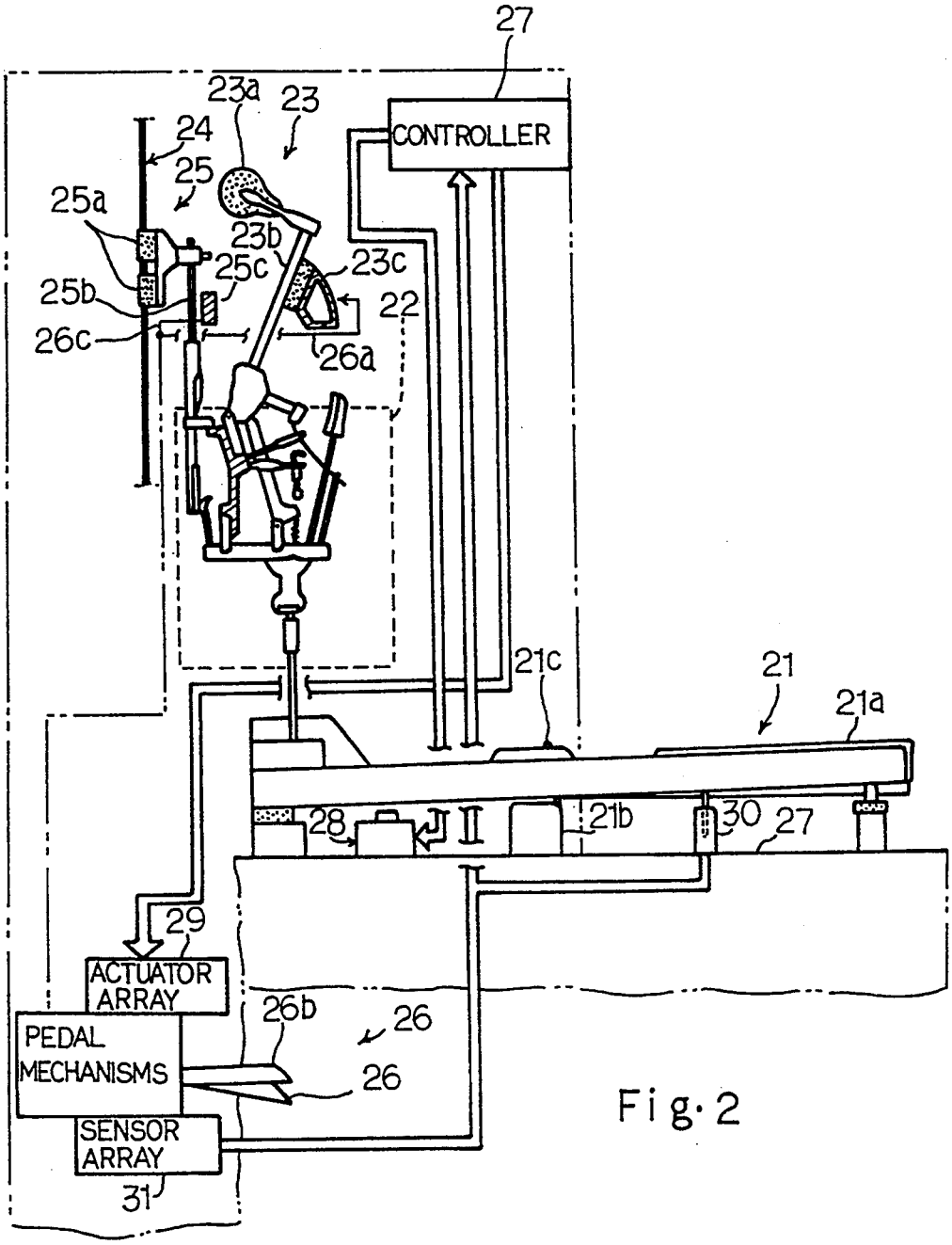
FIG. 2 is a schematic view showing the general arrangement of an automatic player piano according to the present invention.

Referring to FIG. 2 of the drawings, an automatic player piano embodying the present invention largely comprises a keyboard 21, key action mechanisms 22 associated with the keyboard 21, hammer mechanisms 23 respectively driven by the key action mechanisms 22, a plurality sets of music wires 24 respectively struck by the hammer mechanisms 23, damper mechanisms 25 respectively driven by the key action mechanisms 22, and pedal mechanisms 26 associated with the hammer mechanisms 23 and the damper mechanisms 25. These mechanical components are analogous to the components of an acoustic piano, and cooperate for producing sounds in response to a keying-in operation on the keyboard 21. However, the automatic player piano further comprises a controller 27, a first actuator array 28 associated with the keyboard 21, a second actuator array 29 associated with the pedal mechanisms 26, a first sensor array 30 associated with the keyboard 21, and a second sensor array 31 associated with the pedal mechanisms 26. The controller 27 and the associated electric components 28 to 31 cooperate with the mechanical components 21 to 26 for recording a music and reproducing the music.

The keyboard 21 is mounted on a key bed 27, and consists of a plurality of white and black keys arranged as similar to an acoustic piano. One of the keys is shown and labeled with 21*a*. The keys are rockably supported by a balance rail 21b, and are swung with respect to balance pins 21c.

The key action mechanisms 22 are respectively coupled with the keys of the keyboard 21, and are similar to those of an acoustic upright piano. For this reason, no further description is incorporated hereinbelow.

The hammer mechanisms 23 respectively have hammer top felts 23a respectively supported by hammer shanks 23b, and the associated key action mechanisms 22 allow the hammer shanks 23b to be held in contact with a hammer rail 23c while the associated key is released. However, when a player depresses the keys, the associated key action mechanisms 22 drive the hammer mechanisms for rotation toward the music wires 24, and the hammer top felts 23a strike the music wires 24 for producing sounds. Then, the key action mechanisms 22 allow the hammer shanks 23b to return to the initial positions where the hammer shanks 23b are brought into contact with the hammer rail 23c. The hammer rail 23c is coupled with one of the pedal mechanisms 26, and is angularly movable by means of the associated pedal mechanism 26a. The associated pedal mechanism 26a is driven by a soft pedal 26b, and causes the hammer rail 23c to become closer to the music wires 24. In other words, the hammer top felts 23a are moved from a spaced position to a closer position when the player steps on the soft pedal 26b, and return from the closer position to the spaced position if the player releases the soft pedal 26b.

The damper mechanisms 25 respectively have damper felts 25a supported by respective damper wires 25b, and the associated key action mechanisms 22 allow the damper felts 25a to leave the associated music wires 24 before the hammer felts 23a strike the music wires 24. After the hammer top felts 23a are left from the music wires 24, the damper felts 25a return to the initial positions, and are brought into contact with the associated music wires 24. A damper stop rail 25c is provided in association with the damper wires 25b, and is driven by another pedal mechanism 26c linked with a damper pedal 26d. If the player steps on the damper pedal 26d, the pedal mechanism 26c holds the damper felts 25a off, and the damper felts 25a do not return to the initial position even though the hammer top felts 23a return to the initial positions. While the player steps on the damper pedal 26d, the damper felts 25a are maintained in a hold state. However, if the damper pedal 26d is released, the damper felts 25a enters a released state.

Figure 3:
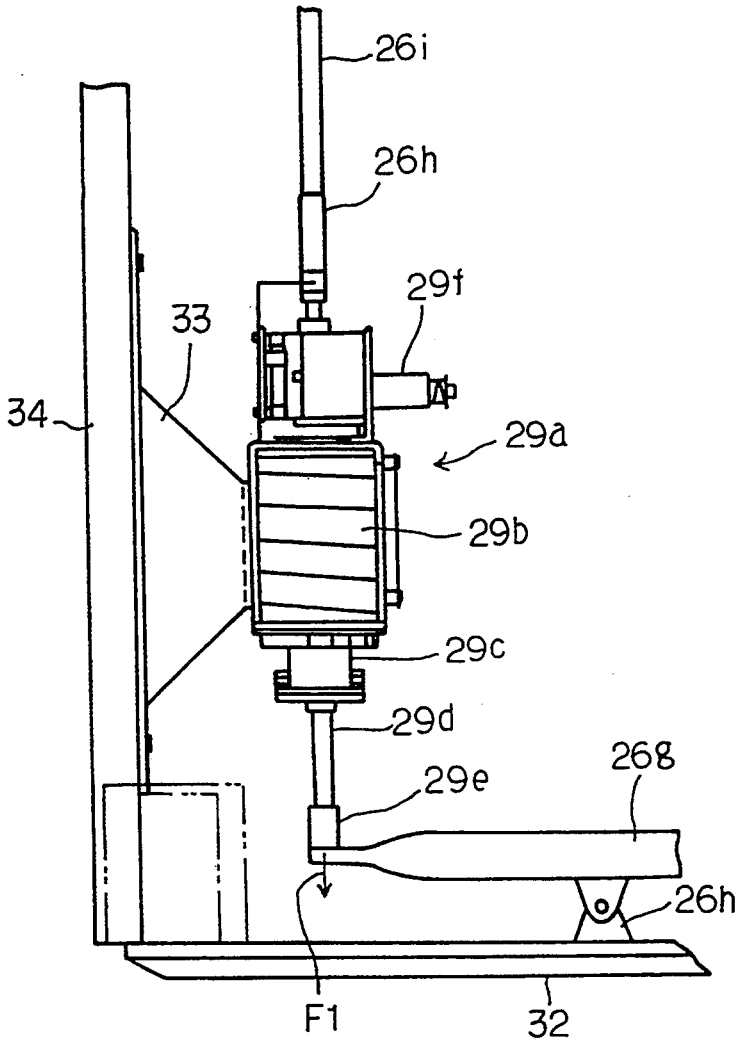
FIG. 3 is a front view showing a pedal mechanism incorporated in the automatic player piano according to the present invention.
Figure 4:
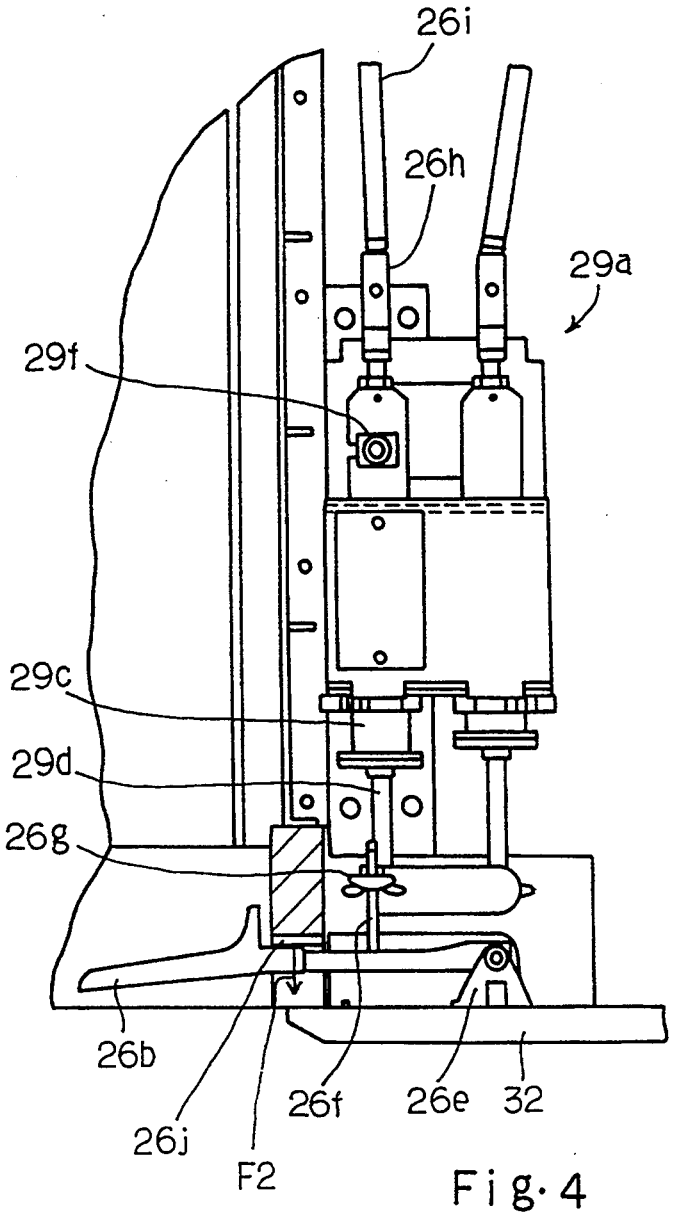
FIG. 4 is a side view showing the pedal mechanism.

As described hereinbefore, the pedal mechanisms 26 have the soft and damper pedals 26b and 26d, and the pedal mechanism 26a for the soft pedal 26b is illustrated in FIGS. 3 and 4. The pedal mechanism 26a is mounted on a bottom plate 32, and the soft pedal 26b is rockably supported by a bracket 26e. The soft pedal 26b is connected through a threaded rod 26f with one end of a pole 26g, and the pole 26g is rockably supported by a bracket 26h. An actuator 29a forming a part of the actuator array 29 is supported by a bracket 33 which in turn is fixed to a side panel 34.

The actuator 29a is of a solenoid operated type, and comprises a solenoid unit 29b and a plunger 29c loosely inserted into the solenoid unit 29b. Though not shown in FIGS. 3 and 4, a return spring downwardly urges the plunger 29c, and a rod 29d is coupled with the plunger 29c. A rubber cap 29e covers the leading end of the rod 29d, and the return spring (not shown) causes the rubber cap 29e to be brought into contact with the other end of the pole 26g in so far as the solenoid unit is deenergized. The rubber cap 29e takes up the impact against the other end of the pole 26g.

The plunger 29c is further coupled through a flexible joint 26h with a pedal rod 26i, and the flexible joint 26h is adopted to adjust the leading end of the pedal rod 26i to the hammer rail 23c. The flexible joint 26h takes up dispersion of the components, and allows an assembly worker to easily assembly the pedal mechanism 26a. Moreover, the flexible joint 26h allows the actuator 29a to laterally deviate from the pedal rod 26i, and enhances flexibility of the space design.

The solenoid operated actuator 29a further comprises an interlock mechanism implemented by a solenoid unit 29f, and the solenoid unit 29f is used for mute lock. When the solenoid unit 29f is energized, the pedal mechanism 26a causes the hammer rail 23c to keep the closer position, and the hammer mechanisms 23 softly strike the associated music wires without manipulation of the soft pedal 26b. The interlock mechanism serves as a mute lock means in this instance. The solenoid operated actuator 29a is stationary with respect to the coil unit 29b of the actuator 29a, and can not move in the direction to which the plunger 29c is moved. However, the solenoid operated actuator 29a is protectable and retractable in the direction perpendicular to the direction of movement of the plunger 29c so that friction takes place therebetween. This results in that the solenoid operated actuator 29a remains in the projecting position even if no current flows after the engagement.

The pedal mechanism 26c for the damper pedal 26d is analogous to the pedal mechanism 26a; however, any lock mechanism is not equipped with the associated solenoid operated actuator. In order to avoid undesirably repetition, no further description is made on the pedal mechanism 26c.

The automatic player piano thus arranged selectively enters an ordinary playing mode without recording, a recording mode and a playback mode of operation. In the ordinary playing mode, a player sequentially depresses the keys, and the music wires 24 produces sounds as similar to an acoustic piano. If the player requests the controller 27 to record the music, the controller 27 cooperates with the first and second sensor arrays 30 and 31, and produces and stores musical data codes for the playback. In the playback mode, the musical data codes are sequentially retrieved, and controller selectively 27 drives the first and second actuator arrays 28 and 29 so that the sounds are reproduced for the recorded music.

In the ordinary playing mode, when the player steps on the soft pedal 26b, the pole 26g is driven for rotation, and the other end of the pole 26g lifts the rod 29d. Since the other end of the pole 26g is only touched with the rubber cap 29e, the angular motion of the pole 26g causes the rubber cap 29e to slide on the other end thereof, and the player feels the soft pedal 26b light.

The upward straight motion is transferred through the rubber cap 29e to the plunger 29c, and the plunger upwardly pushes the pedal rod 26i through the flexible joint 26h. Then, the hammer rail 23c pushes the hammer shanks 23b, and the hammer top felts 23a become closer to the music wires 24. In other words, the hammer top felts 23a is moved from the spaced positions to the closer positions, and the hammer top felts 23a softly strike the associated music wires 24 when the player depresses the associated keys. This results in soft sounds with small volume.

When the player releases the soft pedal 26b, the return spring pulls the plunger 29c down, and the self-weight of the components and the reaction of the hammer rail 23c are added to the elastic force of the return spring. The total force F1 is calculated as follows.

F1=(resilient force of the return spring)+(total self weight of the pedal rod 26i, the plunger 29c and the rod 29d)+(reaction force F2 of soft pedal and reaction force of the hammer rail)

By the aid of force F1, the soft pedal 26b returns to the initial position, and the rubber cap 29e is continuously held in contact with the other end of the pole 26g.

In the playback mode of operation, the controller sequentially retrieves the musical data codes, and drives the first and second actuator arrays 28 and 29. If one of the musical data codes is indicative of the closer position of the hammer top felts 23a, the controller 27 energizes the solenoid unit 29b of the solenoid operated actuator 29a, and the plunger is upwardly moved against the elastic force of the return spring. As a result, the force F1 is removed from the other end of the pole 26g, and the other end of the pole 26g follows the plunger 29c due to the self-weight. Accordingly, the pedal 26b is downwardly moved as if a player steps thereon. The plunger 29c pushes the flexible joint 26h and, accordingly, the pedal rod 26i, and the hammer rail 23c urges the hammer shanks 23b toward the music wires 24. Then, the hammer top felts 23a is moved to the closer position, and the music wires 24 reproduce the soft sounds when the actuators of the first actuator array 28 are selectively energized by the controller 27. Since the solenoid unit 29b urges the plunger against the elastic force of the return spring only, relatively small electromagnetic force can pull the plunger 29c up, and the solenoid operated actuator 29a is smaller in size than that of the prior art.

When the solenoid operated actuator 29a is deenergized, the return spring downwardly pushes the plunger 29c, and the soft pedal 26b is brought into contact with the stopper 26j.

If a background music is, by way of example, requested, the solenoid unit 29f is energized by the controller 27, and the plunger 29c is held in the lifted position. Accordingly, the hammer rail 23c keeps the hammer top felts 23a close to the music wires 24, and the hammer top felts 23a softly strikes at all times. The music wires 24 produce or reproduce faint sounds, and the background music is performed. The solenoid unit 29f is not noisy rather than the geared motor, and does not get caught in any component.

Second Embodiment

Figure 5:
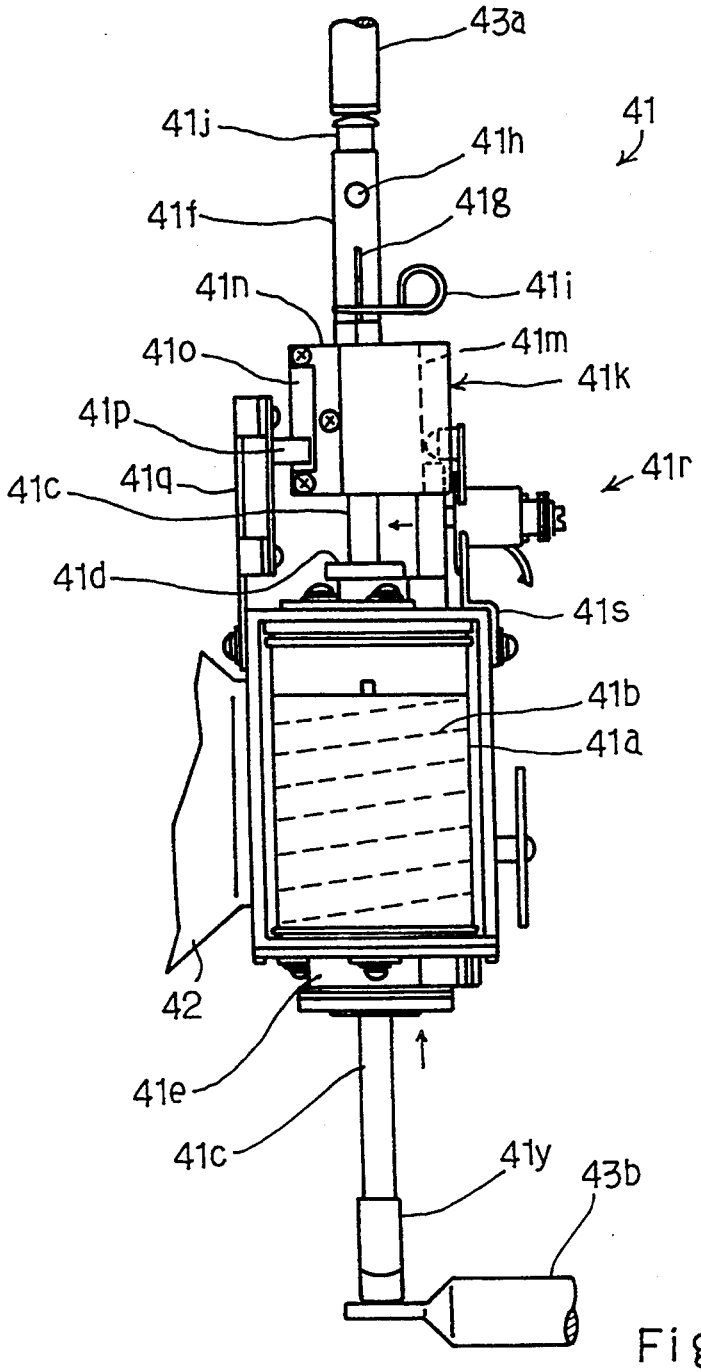
FIG. 5 is a front view showing a solenoid operated actuator for a pedal mechanism incorporated in another automatic player piano according to the present invention.
Figure 6:
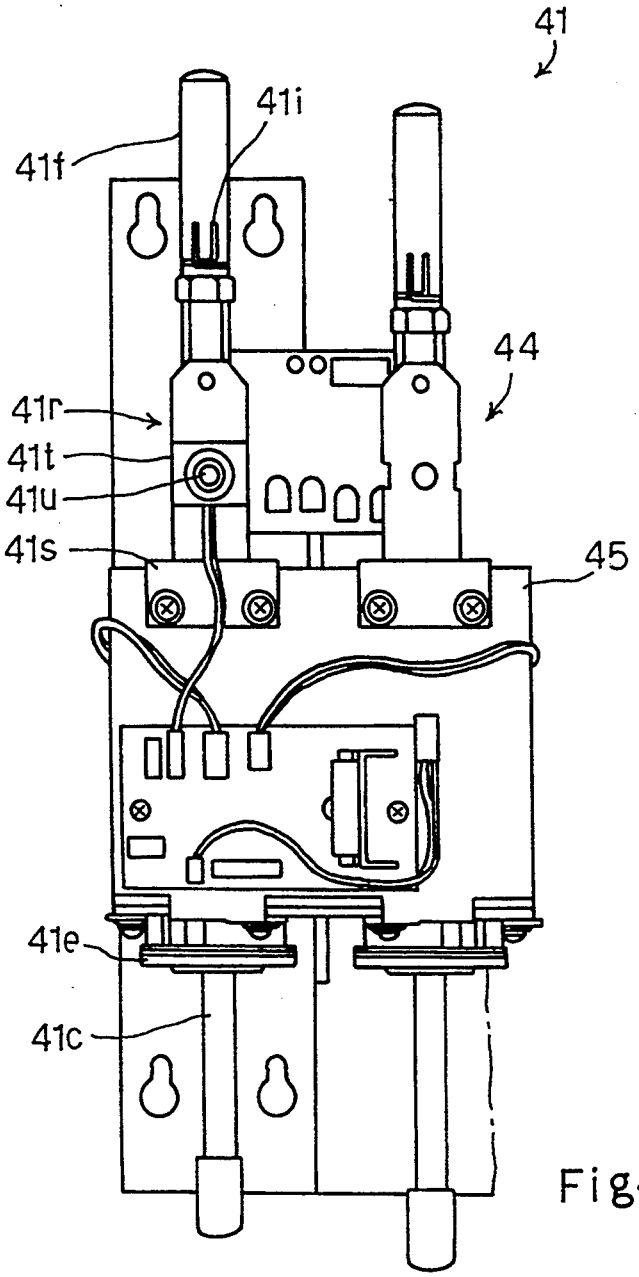
FIG. 6 is a side view showing the solenoid operated actuator shown in FIG. 5.
Figure 7:
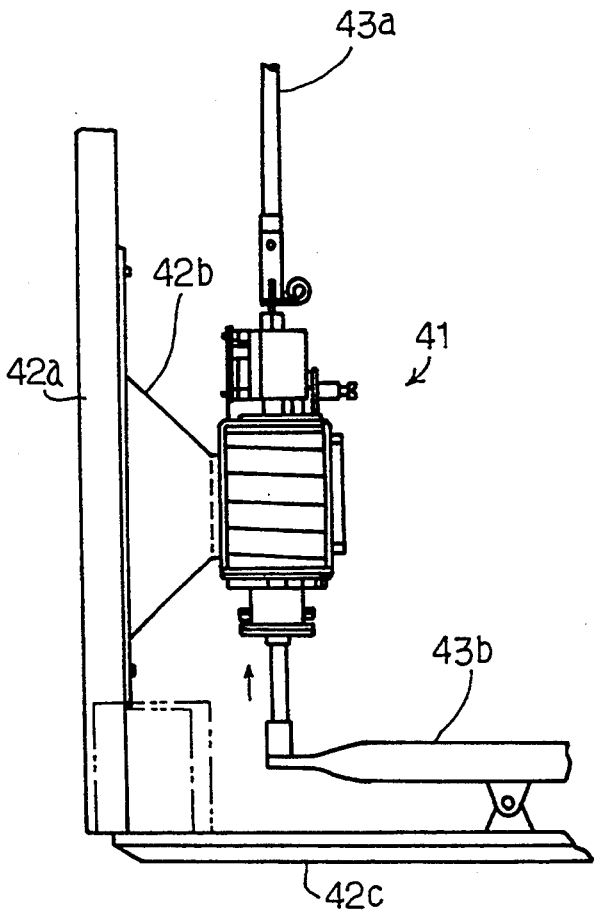
FIG. 7 a front view showing the relation between the solenoid operated actuator and the associated pedal mechanism.

Turning to FIGS. 5 to 7 of the drawings, a solenoid operated actuator 41 is provided in association with a pedal mechanism for a soft pedal (not shown), and the solenoid operated actuator 41 and the pedal mechanism are incorporated in another automatic player piano embodying the present invention. The automatic player piano implementing the second embodiment is similar to the first embodiment except for the solenoid operated actuator 41, and the other components are not described hereinbelow for the sake of simplicity. However, when it is necessary to refer to the other components, the components are identified by the same references as those designating corresponding components of the first embodiment.

The solenoid operated actuator 41 comprises a solenoid unit 41a, and a coil element 41b is incorporated in the solenoid unit 41a. As will be better seen from FIG. 7, the solenoid unit 41a is fixed to a side panel 42a by means of a bracket 42b, and a column-shaped plunger loosely extend through the coil element 41b of the solenoid unit 41a. Upper and lower plunger shafts 41c projects from the lower end of the plunger, and the upper plunger shaft 41c and the plunger are slideably supported by upper and lower journal bearing units 41d and 41e fixed to the solenoid unit 41a. The journal bearing unit 41d allows an assembly worker to regulate the clearance to the plunger by changing the relation between the inner surface thereof and the upper plunger shaft 41c. A cap nut 41f is screwed into the upper end of the upper plunger shaft 41c, and is operative to regulate the total height of the solenoid operated actuator 41. Two slots 41g are formed in the cap nut 41f, and are spaced at 180 degrees. The slots 41g make the cap nut 41f slightly lager in diameter than the upper plunger shaft 41c, and the upper plunger shaft 41c is loosely inserted into. Thereafter, a bar is inserted into a hole 41h, and the cap nut 41f is driven for rotation with the bar. Then, the cap nut 41f is engaged with the cap nut 41f, and a spring 41i clamps the cap nut 41h so as to fix the cap nut 41f to the upper plunger shaft 41c. A rubber cap 41j is attached to the cap nut 41f, and the rubber cap 41j is held in contact with a pedal rod 43a forming a part of the pedal mechanism for the soft pedal.

Figure 8:
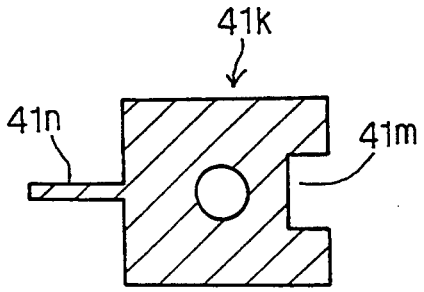
FIG. 8 is a cross sectional view showing a block member incorporated in the solenoid operated actuator.

A generally cubic block member 41k is fixed to the upper plunger shaft 41c, and FIG. 8 illustrates a cross section of the cubic block member 41k. The cubic block member 41k has a groove 41m on the right surface portion, and a plate member 41n projects from the left surface of the cubic block member 41k.

Turning back to FIGS. 5 to 7, a gray scale 41o is fixed to the plate member 41n, and the gray scale 41o measures the displacement of the upper plunger shaft 41c. Namely, The gray scale 41o gradually changes the amount of light passing therethrough along the longitudinal direction thereof. A photo-interrupter 41p is faced to the gray scale 41o, and is fixed to a bracket member 41q which in turn is fixed to a yoke of the solenoid unit 41k. When the plunger shaft 41c is moved, the gray scale 41o is moved together with the plunger shaft 41c. The photo-interrupter 41p continuously radiates light to the gray scale 41o, and the amount of light passing through the gray scale 41o is varied depending upon the displacement of the plunger shaft 41c. The light passing through the gray scale 41o is converted into an electric signal, and the electric signal indicative of the amount of light is supplied to a controller 27.

Figure 9:
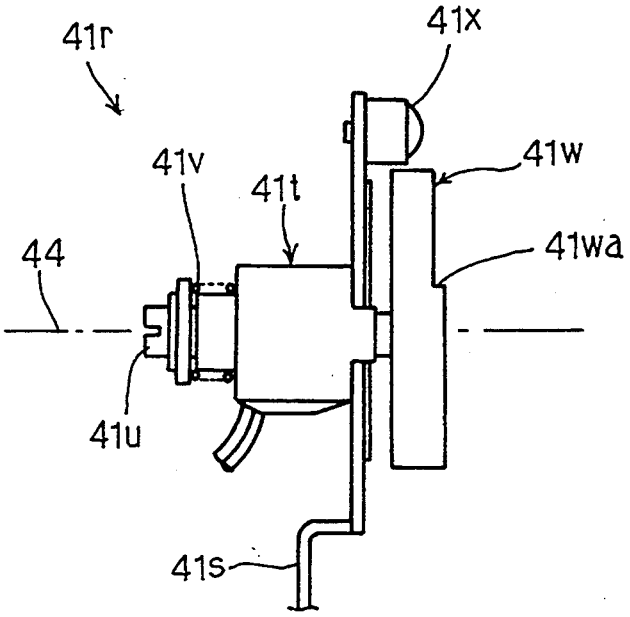
FIG. 9 is a view showing a mute mechanism associated with the solenoid operated actuator.
Figure 10:
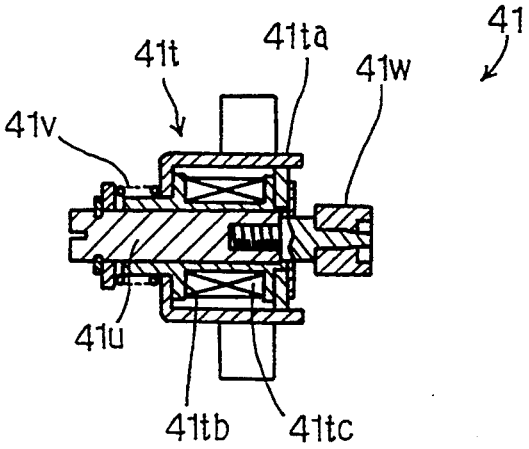
FIG. 10 is a cross sectional view taken along line 44 of FIG. 8 and showing the arrangement of the mute mechanism.

A mute lock mechanism 41r is supported by the solenoid unit 41a by means of a bracket 41s, and the mute lock mechanism 41r is illustrated in detail in FIG. 9. Namely, the mute lock mechanism 41r largely comprises a solenoid unit 41t, a plunger 41u, a return spring 41v and a stopper 41w attached to the leading end of the plunger 41u. The solenoid unit 41t has a yoke member 41ta, a coil bobbin 41tb and a coil member 41tc wound on the coil bobbin 41tb, and causes the plunger 41u to project from and retract into the coil bobbin 41tb. The stopper 41w is elongated in the vertical direction of the solenoid operated actuator 41, and loosely inserted in the groove 41m formed in the cubic block member 41k. The stopper 41w has a shoulder portion 41wa, and is engageable with the lower end of the cubic block member 41k. A pin member 41x is screwed into the bracket member 41s, and is also loosely inserted into the groove 41*m*. The pin member 41*x* prevents the plunger shaft 41*c* from undesirable rotation.

While the plunger 41*u* is retracted into the coil bobbin 41*tb*, the cubic block member 41*k* is freely moved without engagement with the shoulder portion 41*wa*. However, if the plunger 41*u* projects from the coil bobbin 41*tb*, the lower end of the cubic block member 41*k* is brought into abutting engagement with the shoulder portion 41*wa*, and the cubic block member 41*k* and, accordingly, the plunger shaft 41*c* can not be moved downwardly. As a result, the solenoid operated actuator 41 keeps the pedal rod 43*a* upward, and the hammer rail 23*c* causes the hammer top felts 23*a* to be in the closer position.

Turning back to FIGS. 5 and 6, the leading end of the lower plunger shaft 41*c* is covered with a rubber cap 41*y*, and the rubber cap 41*y* is held in contact with one end portion of a pole 43*b* forming another part of the pedal mechanism. The pole 43*b* is rockably mounted on a bottom plate 42*c*, and corresponds to the pole 26*g* of the first embodiment. The rubber cap 41*y* eliminates noises while the pole 43*b* is angularly moved. The solenoid operated actuator 41 is coupled with a solenoid operated actuator associated with another pedal mechanism for a damper pedal by means of a yoke member 45.

The solenoid operated actuator 41 and the pedal mechanism for the soft pedal behaves as similar to those of the first embodiment in the ordinary playing mode and the playback mode of operation. For this reason, the following description is focused upon the behavior of the mute lock mechanism 41*r*. If the automatic player piano is requested to perform a background music, the controller 27 energizes the solenoid unit 41*a*, and the pedal rod 43*a* allows the hammer rail 23*c* to move the hammer top felts 23*a* to the closer position. Thereafter, the controller 27 energizes the solenoid unit 41*t* so that the plunger 41*u* projects from the coil bobbin 41*tb*. As a result, the shoulder portion 41*wa* is brought into contact with the lower end of the cubic block member 41*k*, and the plunger of the solenoid operated actuator 41 is never retracted into the solenoid unit 41*a*. For this reason, the hammer top felts 23*a* softly strike the associated music wires 24, and the music wires 24 produces faint sounds for the background music.

If the same mechanism as the mute lock mechanism is provided for the solenoid operated actuator 44, the mechanism allows the damper felts 25*a* to be lightly touched with the music wires 24, and continuously keeps a half pedal state.

Additionally, the cubic block member 41*k* and the gray scale 41*o* may be located under the solenoid unit 41*a* in association with the lower plunger shaft 41*c*, and the solenoid unit 41*r* may be separately supported by a yoke.

As will be understood from the foregoing description, the automatic player piano implementing the second embodiment achieves all the advantages of the first embodiment, and the mute lock mechanism is embodied by the combination of the cubic block member 41*k*, the solenoid unit 41*r* and the plate member 41*w*.

Third Embodiment

Figure 11:
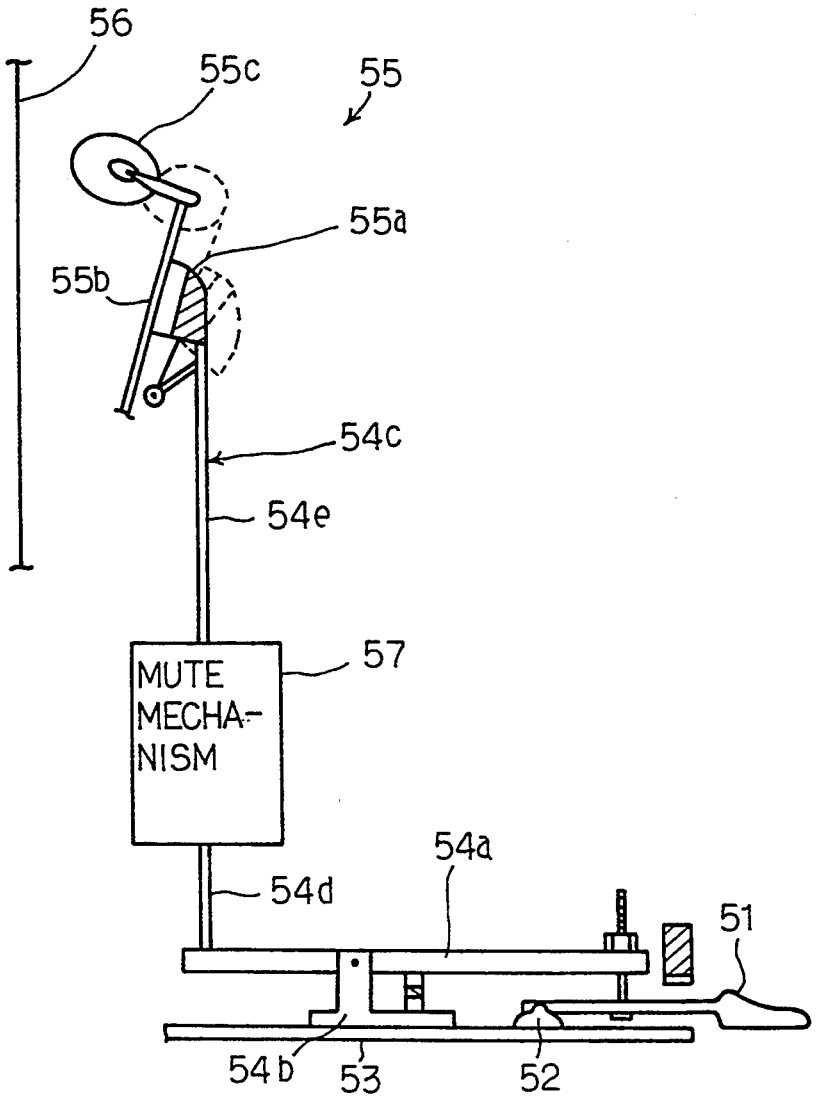
FIG. 11 is a schematic side view showing an essential part of yet another automatic player piano according to the present invention.

Turning to FIG. 11 of the drawings, a pedal mechanism for a soft pedal 51 is rockably supported by a bracket 52 on a bottom plate 53, and a pole 54*a* is coupled at one end thereof with the soft pedal 51. The pole 54*a* is rockably supported by a bracket 54*b* on the bottom plate 53, and a pedal rod 54*c* is driven by the pole 54*a*. The pedal rod 54*c* is connected with a hammer rail 55*a*, and the hammer rail 55*a* forms a hammer mechanism 55 together with a hammer shank 55*b* and a hammer top felt 55*c*. Though not shown in FIG. 11, the hammer mechanism 55 is driven by a key action mechanism when an associated key is depressed by a player, and strikes a set of music wires 56 for producing a sound. The hammer rail 55*a* is angularly movable, and allows the hammer top felt 55*c* between a spaced position drawn with a broken line and a closer position drawn with a real line. While the hammer top felt 55*c* remains in the spaced position, the hammer top felt 55*c* strongly strikes the musical wires 56, and the music wires produces a loud sound. On the other hand, if the hammer top felt 55*c* is moved to the closer position, the music wires are softly struck, and produces a faint sound. Although only one set of hammer mechanism 55 is shown together with the associated music wires, a plurality of hammer mechanisms are incorporated in the automatic player piano together with key action mechanisms coupled with keys.

Figure 12:
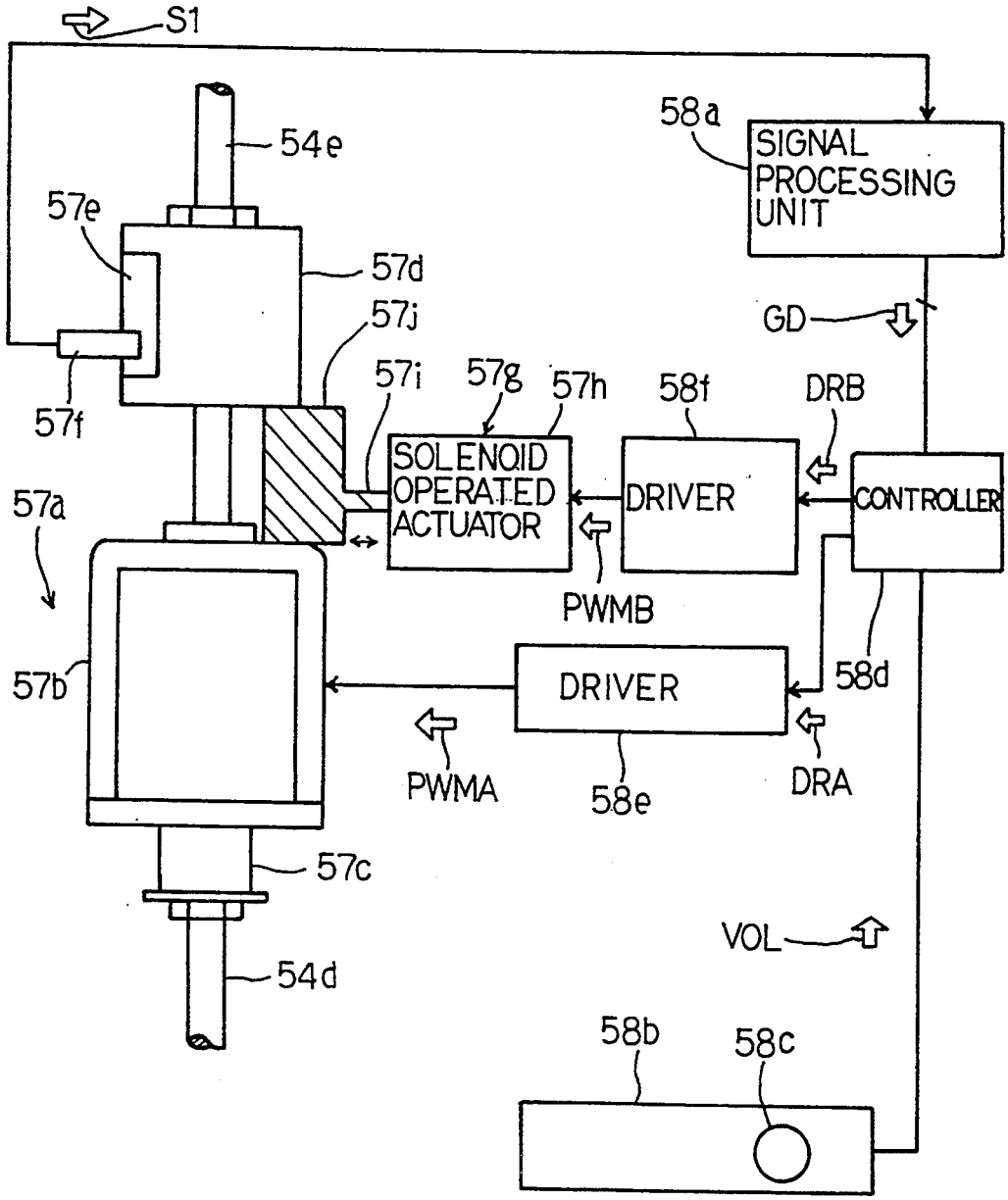
FIG. 12 is a block diagram showing a feedback loop incorporated in the yet another automatic player piano according to the present invention.

A mute lock mechanism 57 is provided in association with a solenoid operated actuator 57*a* which in turn is associated with the pedal mechanism for the soft pedal 51. FIG. 12 illustrates the detailed arrangement of the mute lock mechanism. The solenoid operated actuator 57*a* is inserted between lower and upper pedal sub-rods 54*d* and 54*e*, and the solenoid operated actuator 57*a* is supported by a side panel. The solenoid operated actuator 57*a* comprises a solenoid unit 57*b* and a plunger 57*c* upwardly protectable from and retractable into the solenoid unit 57*b*, and the plunger 57*c* is coupled at the lower end thereof with the lower pedal sub-rod 54*d* and at the upper end thereof with the upper pedal sub-rod 54*e*.

A bracket member 57*d* is fixed to the plunger 57*c*, and is, accordingly, movable together with the plunger 57*c*. A translucent gray scale 57*e* is attached to the bracket member 57*d*, and the amount of light passing through the translucent gray scale 57*e* is variable with the position of the plunger 57*c*. A photo-interrupter 57*f* is associated with the translucent gray scale 57*e*, and a light emitting unit and a photo-sensing unit of the photo-interrupter are located on both sides of the translucent gray scale 57*e*. Since the photo-interrupter 57*f* is stationary with respect to the solenoid unit 57*b*, the photo-current produced by the photo-sensing unit is variable with the position of the plunger 57*c*. An analog photo-detecting signal S1 is indicative of the amount of photo-current, and is supplied from the photo-sensing unit to a signal processing unit 58*a*.

The signal processing unit 58*a* amplifies the analog photo-detecting signal S1, and coverts the amplified analog photo-detecting signal S1 into a digital gray scale data signal GD indicative of the actual position of the plunger 57*c*. A manipulating panel 58*b* is attached to an appropriate position on a piano case, and a player can manipulate switches on the manipulating panel 58*b*. One of the switches is assigned for changing loudness of sounds, and is labeled with 58*c*. The volume switch 58*b* produces a digital volume signal VOL indicative of the loudness of sounds, and the digital volume signal VOL is supplied to a controller 58*d*. The controller compares the digital gray scale data signal with the digital volume signal VOL, and produces a driving signal DRA for a driver 58*e* associated with the solenoid operated actuator 57*a* as well as a driving signal DRB for another driver 58*f* associated with another actuator 57*g*, if necessary.

The solenoid operated actuator 57*g* is stationary with respect to the solenoid unit 57*b*, and comprises a solenoid unit 57*h* and a plunger 57*i* protectable from and retractable into the solenoid unit 57*h*. A stopper 57*j* is coupled with the leading end of the plunger 57*i*, and is movable between an engageable position and a spaced position. While the plunger 57*i* is retracted into the solenoid unit 57*h*, the stopper 57*j* remains in the spaced position, and allows the bracket member 57*d* and, accordingly, the plunger 57*c* to freely move. However, if the plunger 57*i* projects from the solenoid unit 57*h*, the stopper 57*j* is brought into engagement with the bracket member 57*d*, and the plunger 57*c* can not be moved due to friction between the stopper 57*j* and the bracket member 57*d*.

The driver 58*f* is responsive to the driving signal DRB, and supplies a pulse signal PWMB with a predetermined duty ratio to the solenoid operated actuator 57*g* in the presence of the driving signal DRB. However, the driver 58*f* never supplies the pulse signal PWMB to the solenoid operated actuator 57*g* in the absence of the driving signal DRB. While the pulse signal PWMB is supplied to the solenoid operated actuator 57*g*, the plunger 57*i* projects from the solenoid unit 57*h*, and the stopper 57*j* is moved to the engageable position. In the engageable position, the stopper 57*j* is brought into abutting engagement with the bracket member 57*d*, and the plunger 57*c* is fixed to the position even if the solenoid operated actuator is deenergized. However, the plunger 57*i* is retracted into the solenoid unit 57*h* by means of a return spring (not shown) in the absence of the pulse signal PWMB, and allows the stopper 57*j* to be moved to the spaced position.

The driver 58*e* is also responsive to the driving signal DRA, and produces a pulse signal PWMA with variable duty ratio in the presence of the driving signal DRA. The driving signal DRA contains a piece of data information indicative of the duty ratio, and the driver 58*e* tailors the pulse signal PWMA in accordance with the piece of data information. Namely, if the actual position of the plunger 57*c* and, accordingly, the bracket member 57*d* are lower than the target position designated by the digital volume signal VOL, the controller 58*d* changes the piece of data information for increasing the duty ratio of the pulse signal PWMA, and the driver 58*e* increases the duty ratio of the pulse signal PWMA. The solenoid unit 57*b* increases the magnetoelectric force, and the plunger 57*c* further projects from the solenoid unit 57*b* against elastic force of a return spring (not shown). On the other hand, if the plunger 57*c* is too high, the controller instructs the driver to decrease the duty ratio of the pulse signal PWMA, and the return spring retracts the plunger 57*c* due to the decreased electromagnetic force. Thus, the feedback loop consisting of the photo-interrupter 57*f* associated with the gray scale 57*e*, the signal processing unit 58*a*, the controller 58*d* associated with the volume switch 58*c* and the driver 58*e* regulates the plunger 57*c* and, accordingly, the pedal sub-rod 54*e* to the target position corresponding to the volume indicated by the digital volume signal VOL. In this instance, the bracket member 57*d*, the gray scale 57*e*, the photo-interrupter 57*f*, the signal processing unit 58*a*, the controller 58*d*, the volume switch 58*c*, the drivers 58*e* and 58*f*, the solenoid operated actuator 57*g* and the stopper 57*j* form in combination a mute lock system.

Figure 13:
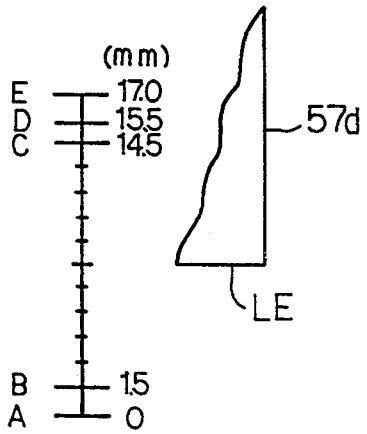
FIG. 13 is a view showing relation between a volume switch and a bracket member incorporated in the essential part.

FIG. 13 shows a movable range of the plunger 57*c* and, accordingly, bracket member 57*d*, the target volume indicated by the digital volume signal VOL and the stopper 57*j*. In this instance, the pedal sub-rod 54*e* is movable from a free position A at zero millimeter to the highest position E at 17 millimeter, and the lower portion of the bracket member 57*d* is illustrated together with the scale indicative of the movable range of the pedal sub-rod 54*e*. While the soft pedal 51 is released, the pedal sub-rod 5*e* remains in the free position A at zero millimeter. However, when the player fully steps on the soft pedal 51, the pedal sub-rod 54*e* is upwardly moved to the highest position E. The movable range has intermediate positions B to D, and are corresponding to respective positions between zero to 17.0 millimeters. While designing the automatic player piano, the designer can regulate the interlock position of the bracket member 57*d* to any height such as B or D, and the plunger 57*c* is kept at the selected position even if the soft pedal is released.

The volume switch 58*c* is adjustable to an arbitrary value ranging from the standard volume at zero to the negative value −10, and the stopper 57*j* is moved to the engageable position if the volume switch 58*c* is adjusted between −7 to −10. When the volume switch 58*c* is adjusted to a certain value between −7 and −10, the lower end LE of the bracket member 57*d* is fixed to a corresponding position such as C or D, and the positions C and D are hereinbelow referred to as "mute position".

Figure 14:
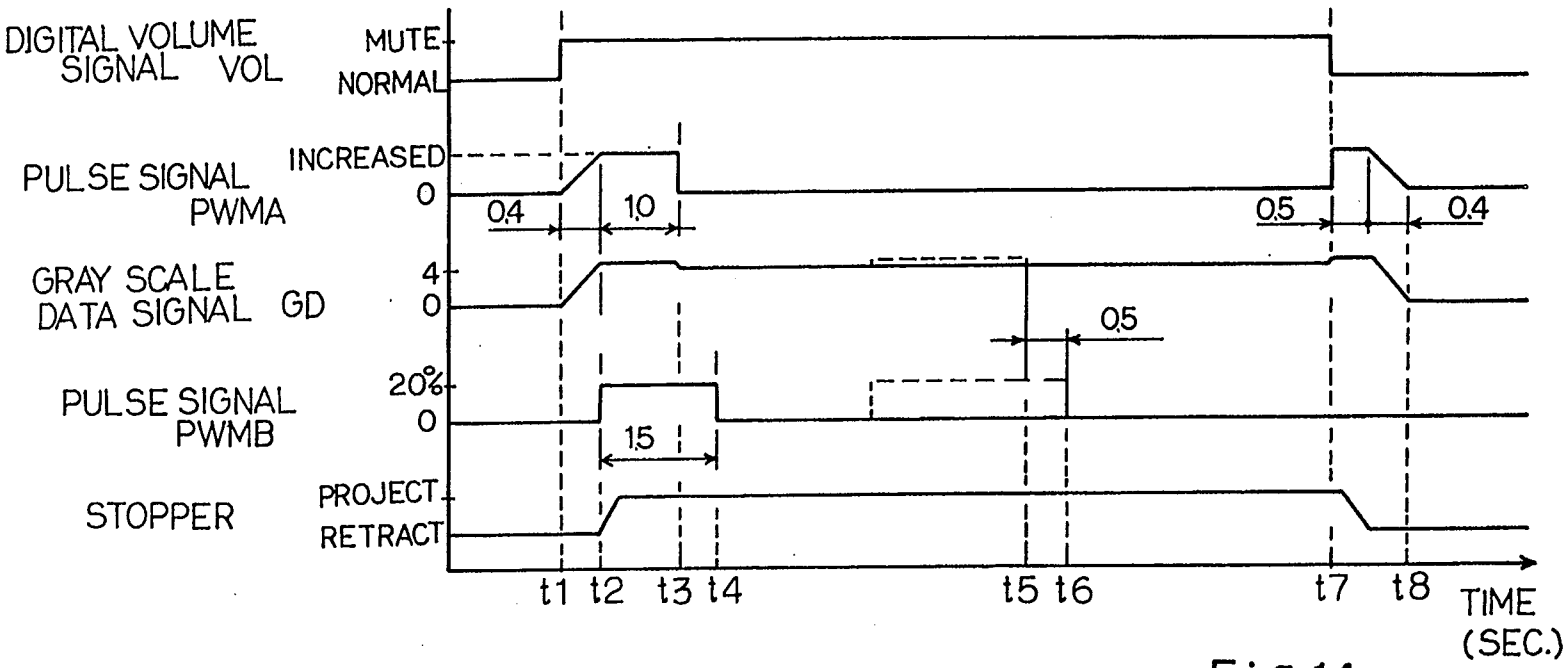
FIG. 14 is a time chart showing the control sequence of the yet another automatic player piano.
Figure 15A:
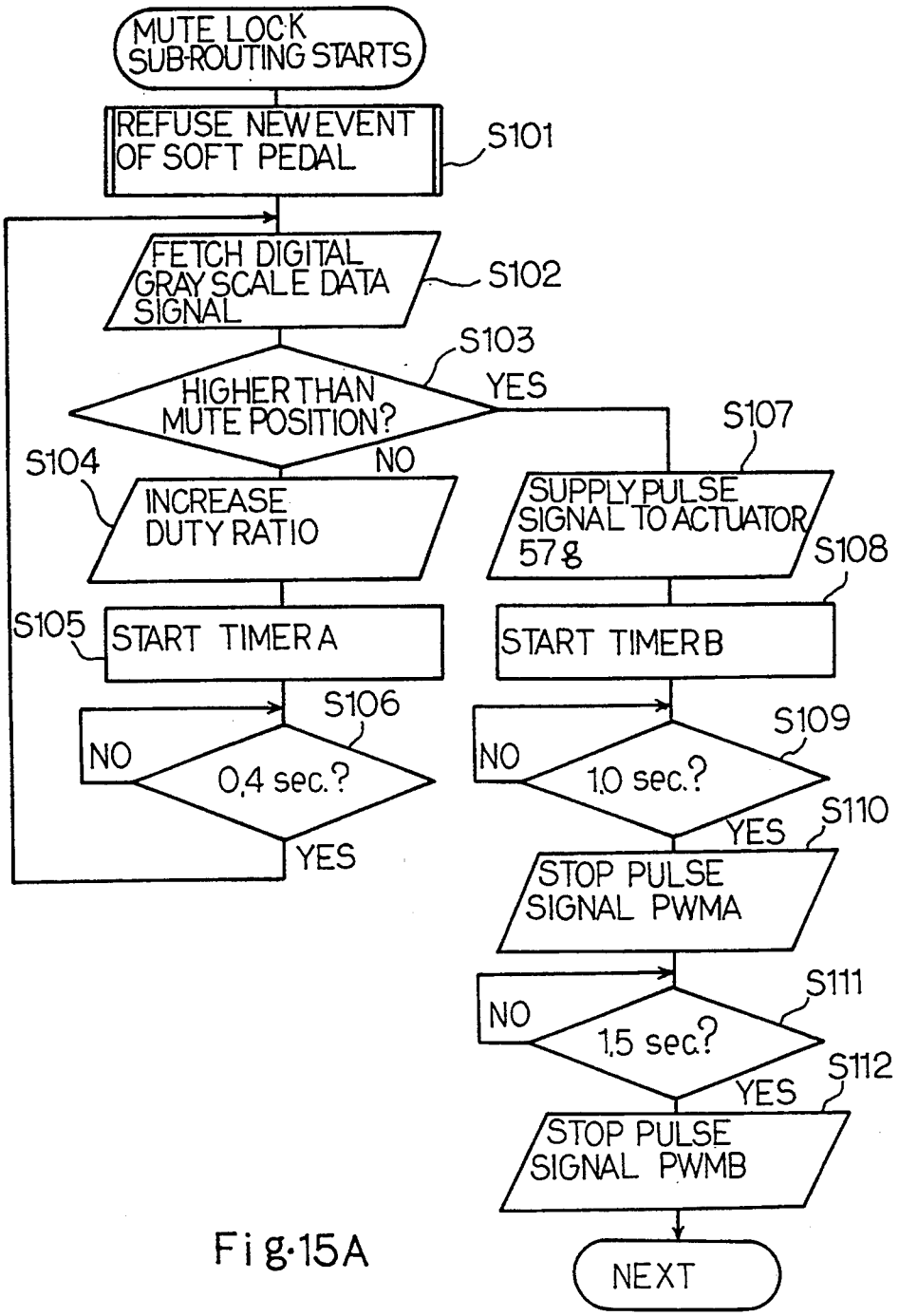
FIGS. 15A to 15C are flow charts showing a program sequence executed by a controller incorporated in the yet another automatic player piano.
Figure 15B:
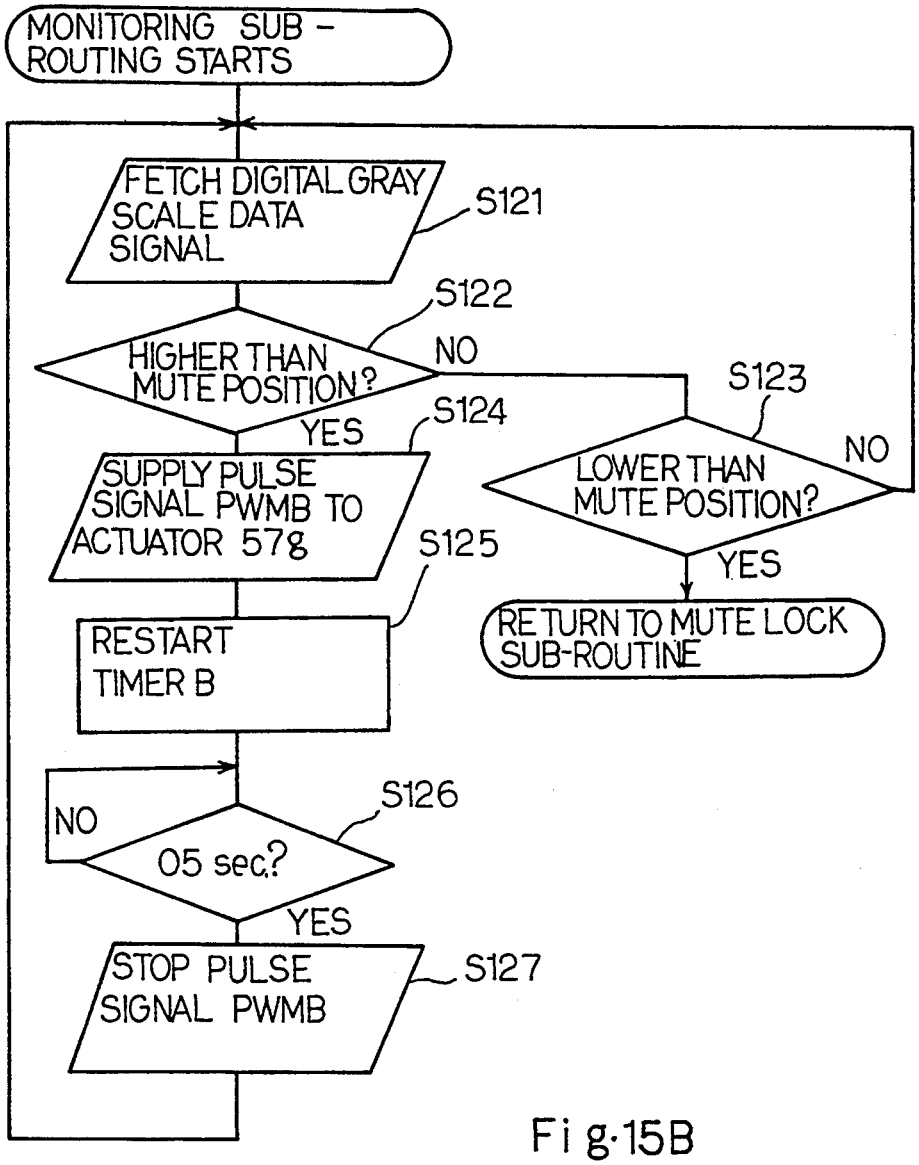
Figure 15C:
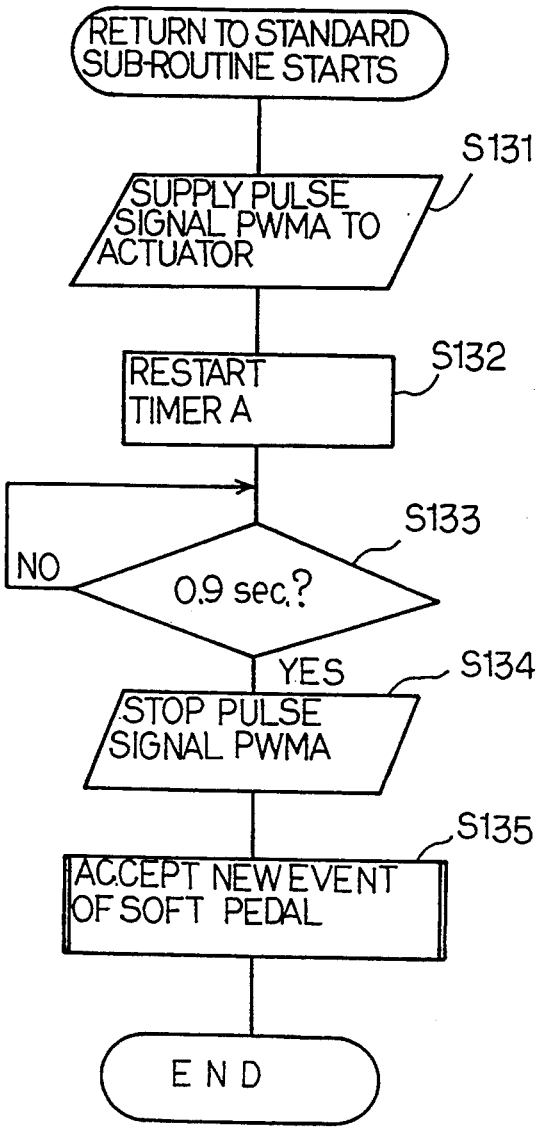

Turning to FIG. 14 of the drawings, a control sequence of the automatic player piano is illustrated, and the control sequence is supervised by the controller 58*d* operative to execute a program sequence shown in FIGS. 15A to 15C. Assuming now that the volume switch 58*c* is adjusted to a certain value corresponding to the mute position at time t1, the controller starts on executing a mute lock sub-routine shown in FIG. 15A. Namely, the controller 58*d* proceeds to step S101, and refuses receipt of a new event of the soft pedal 51 supplied from a sequencer (not shown). Subsequently, the controller 58*d* fetches the digital gray scale data signal GD as by step S102, and the controller 58*d* compares the actual position of the bracket member 57*d* indicated by the digital gray scale data signal GD with the mute position indicated by the digital volume signal GD to see whether or not the actual position is higher than the mute position as by step S103. If the answer to step 103 is given negative, the controller 58*d* proceeds to step S104, and instructs the driver 58*e* to increase the duty ratio of the pulse signal PWMA. Then, the controller 58*d* starts a timer A incrementing time as by step S105, and monitors the timer A to see whether or not a predetermined time period of 0.4 second is expired as by step S106. If the predetermined time period is expired, the answer to step S106 is given affirmative, and the controller 58*d* returns to step S102. Thus, the controller 58*d* reiterates a loop consisting of steps 102 to 106 until the bracket member 57*d* reaches the mute position. If only a single execution of the loop results in the mute position, the control sequence reaches time t2 of FIG. 14.

When the bracket member 57*d* reaches the mute position, the answer to step S102 is given affirmative, and the controller 58*d* proceeds to step 107. At step S107, the controller 58*d* instructs the driver 58*f* to supply the pulse signal PWMB to the solenoid operated actuator 57*g*, and starts a timer B incrementing time as by step S108. Then, the controller 58*d* monitors the timer B to see whether or not a predetermined time period of 1.0 second is expired as by step S109. While the timer B increments the time toward the predetermined time period of 1.0 second, the plunger 57*i* projects from the solenoid unit 57*h*, and allows the stopper 57*j* to move into the engageable position. When the predetermined time period of 1.0 second is expired, the control sequence reaches time t3 of FIG. 14, and the answer step S109 is given affirmative.

With the affirmative answer, the controller 58*d* proceeds to step S110, and instructs the driver 58*e* not to supply the pulse signal PWMA as by step S110. then, the controller 58*d* proceeds to step S111 to see whether or not the timer B is indicative of 1.5 seconds from step S108. While the timer B increments the time toward 1.5 seconds, the plunger 57*c* is downwardly moved by the aid of the return spring, and the lower end LE of the bracket member 57*d* is brought into engagement with the stopper 57*j*. When the timer B reaches 1.5 seconds, the control sequence of FIG. 14 reaches time t4, and the answer to step S111 is given affirmative.

With the affirmative answer, the controller proceeds to step S112, and instructs the driver 58*f* to stop the pulse signal PWMB. Even if the driver 58*f* stops the pulse signal PWMB, the friction between the bracket member 57*d* and the stopper 57*j* keeps the bracket member 57*d* and the stopper 57*j* engaged with each other, and the pedal rod 54*c* causes the hammer top felts 55*c* to be in the closer position. For this reason, even if the key action mechanism drives the hammer top felt 55*c*, hammer top felt 55*c* softly strikes the music wires 56, and the music wires 56 produce faint sound.

While the automatic player piano stays in the mute lock mode, the controller 58*d* periodically executes a monitoring sub-routine shown in FIG. 15B so as to confirm that the stopper 57*j* is held in engagement with the bracket member 57*d*, and returns to the mute lock sub-routine. Namely, the controller 58*d* fetches the digital gray scale data signal GD as by step S121, and checks the mute position to see whether or not the actual position is higher than the mute position as by step S122. If the answer to step S122 is given negative, there is a possibility that the bracket member 57*d* is released from the stopper 57*j* due to, for example, depression of the soft pedal 51. With the negative answer, the controller 58*d* proceeds to step S123, and checks the digital gray scale data signal GD to see whether or not the actual position is lower than the mute position. If the answer to step S123 is given affirmative, the stopper 57*j* is retracted from the engageable position, and the pedal mechanism for the soft pedal 51 allows the hammer top felts 55*c* to return to the spaced position. In order to keep the hammer top felts 55*c* in the closer position, the controller 58*d* returns to the mute lock sub-routine, and sequentially executes steps S101 to S112 again. However, if the answer to step S123 is given negative, the controller confirms that the stopper 57*j* stays in the regular position, and returns to step S121 again.

If the actual position of the bracket member 57*d* is higher than the mute position, the answer to step S122 is given affirmative, and the controller notices that the soft pedal 51 is undesirably depressed. Then, the controller 58*d* proceeds to step 124, and instructs the driver 58*f* to supply the pulse signal PWMB to the solenoid operated actuator 57*g*. The controller 58*d* restarts the timer B, and monitors the timer B to see whether or not the predetermined time period of 0.5 second is expired as by step S126. While the timer B increases the time toward 0.5 second, the plunger 57*i* projects from the solenoid unit 57*h*, and the stopper 57*j* is moved to the engageable position. When the predetermined time period of 0.5 second is expired, the answer to step S126 is given affirmative, and the controller 58*d* instructs the driver 58*f* to stop the pulse signal PWMB as by step S127. Thereafter, the controller 58*d* returns to step S121, and reiterates the loop consisting of steps S121 to S127 for keeping the bracket member 57*d* and the stopper 57*j* engaged. If the stopper 57*j* is continuously engaged with the bracket member 57*d*, the answers to steps S122 and S123 are given negative. However, if not, the answer to either step S122 or S123 is given affirmative, and the controller executes the mute lock sub-routine or the loop consisting of steps S121, S122 and S124 to S127 so that the stopper 58*j* is brought into engagement with the bracket member 57*d* again.

If the volume switch 58*c* is changed to a certain value indicative of the outside of the mute position between −7 and −10. The controller 58*d* executes a return to standard sub-routine shown in FIG. 15C. Namely, the controller 58*d* instructs the driver 58*e* to supply the pulse signal PWMA to the solenoid operated actuator 57*a* as by step S131, and restart the timer A incrementing time as by step S132. While the timer A increments the time toward 0.9 second, the plunger 57*c* is upwardly moved, and the return spring of the solenoid operated actuator 57*g* retracts the plunger 57*i* into the solenoid unit 57*h*.

When the timer A reaches 0.9 second, the answer to step S134 is given affirmative, and the controller 58*d* instructs the driver 58*e* to stop the pulse signal PWMA as by step S135. Then, the return spring of the solenoid operated actuator 57*a* allows the plunger 57*c* to downwardly move, and the hammer rail 55*a* becomes controllable with the soft pedal 51. Times t7 and t8 of FIG. 14 are indicative of the predetermined time period of 0.9 second between step S133 and S134.

After step S134, the controller 58*d* proceeds to step S135, and a new event of the soft pedal 51 becomes acceptable. As a result, musical data codes are sequentially retrieved for a playback, and the controller 58*d* is responsive to the musical data codes.

Figure 16A:
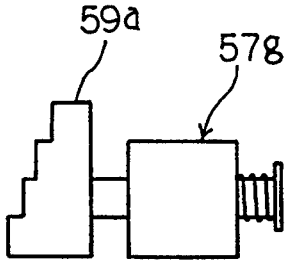
FIGS. 16A to 16C are partially cut-away side views showing modifications of a stopper incorporated in the yet another automatic player piano.
Figure 16B:
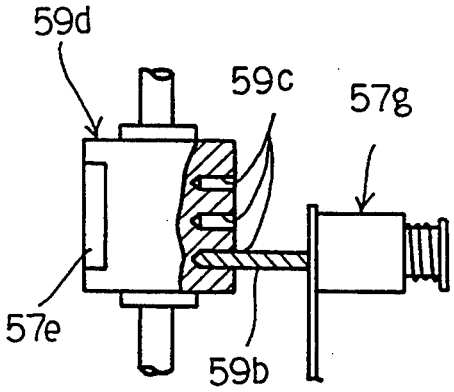
Figure 16C:
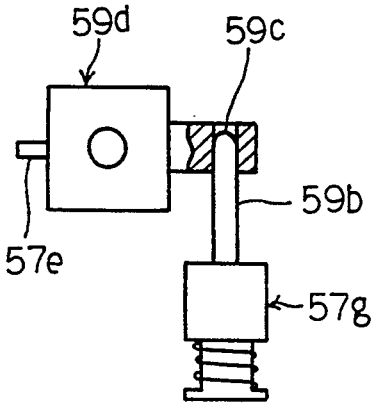

The stopper 57*j* may be formed as shown in FIGS. 16A to 16C so as to keep the bracket member at one of the intermediate positions such as C or D. The stopper 59*a* has a stepped surface, and the bracket member 57*d* is brought into one of the steps of the stopper 59*a*.

If a rod-shaped stopper 59*b* is driven by the solenoid operated actuator 57*g* as shown in FIGS. 16B and 16C, holes 59*c* are formed in a bracket member 59*d*, and the rod-shaped stopper 59*b* is selectively inserted into one of the holes 59*c* so as to keep the bracket member 59*d* at one of the intermediate positions.

As will be understood from the foregoing description, the feedback loop regulates the plunger 57*c* to an appropriate position, and any sensor array is not incorporated in the automatic player piano for the mute lock mechanism. This results in simple structure of the automatic player piano. Moreover, any wire is used in the mute lock mechanism, and malfunction does not take place in the mute lock mechanism.

Fourth Embodiment

Figure 17:
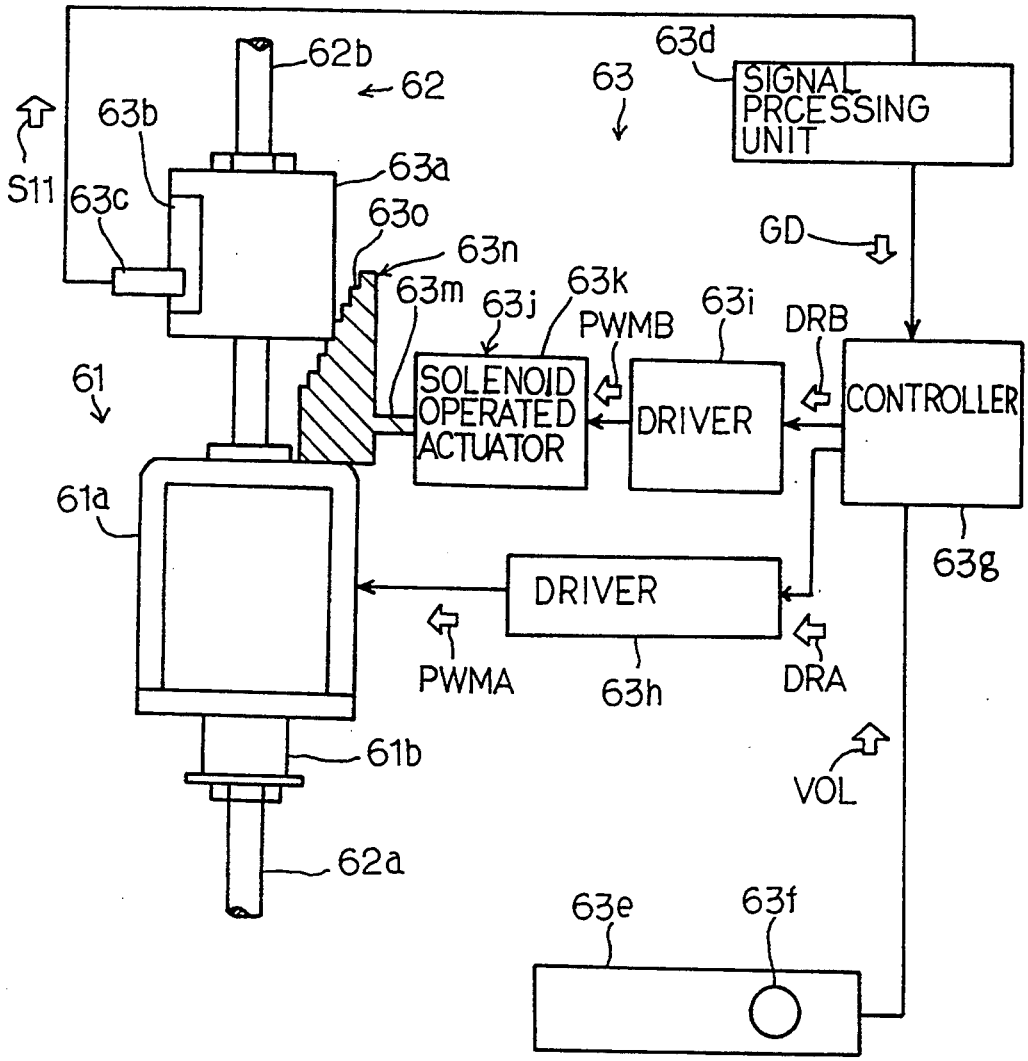
FIG. 17 is a block diagram showing a feedback loop incorporated in still another automatic player piano according to the present invention.

Turning to FIG. 17 of the drawings, a mute lock mechanism incorporated in still another automatic player piano embodying the present invention is associated with a solenoid operated actuator 61 for a soft pedal mechanism 62. The automatic player piano further comprises other mechanical components and other electric components as similar to the first embodiment. However, no description is made on the other mechanical components and the other electric components for avoiding repetition, and the other mechanical components and the other electric components are identified by the same references as the corresponding components of the first embodiment, if necessary.

The solenoid operated actuator 61 is inserted between lower and upper pedal sub-rods 62*a* and 62*b*, and the solenoid operated actuator 61 is supported by a side panel (not shown). The solenoid operated actuator 61 comprises a solenoid unit 61*a* and a plunger 61*b* upwardly protectable from and retractable into the solenoid unit 61*a*, and the plunger 61*b* is coupled at the lower end thereof with the lower pedal sub-rod 62*a* and at the upper end thereof with the upper pedal sub-rod 62*b*.

A bracket member 63*a* is fixed to the plunger 61*b*, and is, accordingly, movable together with the plunger 61*b*. A translucent gray scale 63*b* is attached to the bracket member 63*a*, and the amount of light passing through the translucent gray scale 63*b* is variable with the position of the plunger 61*b*. A photo-interrupter 63*c* is associated with the translucent gray scale 63*b*, and a light emitting unit and a photo-sensing unit of the photo-interrupter 63*c* are located on both sides of the translucent gray scale 63*b*. Since the photo-interrupter 63*c* is stationary with respect to the solenoid unit 61*a*, the photo-current produced by the photo-sensing unit is variable with the position of the plunger 61*b*. An analog photo-detecting signal S11 is indicative of the amount of photo-current, and is supplied from the photo-sensing unit to a signal processing unit 63*d*.

The signal processing unit 63*d* amplifies the analog photo-detecting signal S11, and converts the amplified analog photo-detecting signal S11 into a digital gray scale data signal GD indicative of the actual position of the plunger 57*c*. A manipulating panel 63*e* is attached to an appropriate position on a piano case, and a player can manipulate switches on the manipulating panel 63*e*. One of the switches is assigned for changing loudness of sounds, and is labeled with 63*f*. The volume switch 63*f* produces a digital volume signal VOL indicative of the loudness of sounds, and the digital volume signal VOL is supplied to a controller 63*g*. The controller 63*g* compares the digital gray scale data signal GD with the digital volume signal VOL, and produces a driving signal DRA for a driver 63*h* associated with the solenoid operated actuator 61 as well as a driving signal DRB for another driver 63*i* associated with another actuator 63*j*, if necessary.

The solenoid operated actuator 63*j* is stationary with respect to the solenoid unit 61*a*, and comprises a solenoid unit 63*k* and a plunger 63*m* protectable from and retractable into the solenoid unit 63*k*. A stopper 63*n* is coupled with the leading end of the plunger 63*m*, and is movable between an engageable position and a spaced position. The stopper 63*n* has a stepped front surface 63*o*, and each step is engageable with the bottom surface of the bracket member 63*a*. While the plunger 63*m* is retracted into the solenoid unit 63*k*, the stopper 63*n* remains in the spaced position, and allows the bracket member 63*a* and, accordingly, the plunger 61*b* to freely move. However, if the plunger 63*m* projects from the solenoid unit 63*k*, the stopper 63*n* is brought into engagement with the bracket member 63*a*, and the plunger 61*b* can not be moved anymore.

The driver 63*i* is responsive to the driving signal DRB, and supplies a pulse signal PWMB with a predetermined duty ratio to the solenoid operated actuator 63*j* in the presence of the driving signal DRB. However, the driver 63*i* never supplies the pulse signal PWMB to the solenoid operated actuator 63*j* in the absence of the driving signal DRB. While the pulse signal PWMB is supplied to the solenoid operated actuator 63*j*, the plunger 63*m* projects from the solenoid unit 63*k*, and the stopper 63*n* is moved to the engageable position. In the engageable position, the stopper 63*n* is brought into abutting engagement with the bracket member 63*a*, and the plunger 61*b* is fixed to the position even if the solenoid operated actuator is deenergized. However, the plunger 63*m* is retracted into the solenoid unit 63*k* by means of a return spring (not shown) in the absence of the pulse signal PWMB, and allows the stopper 63*n* to be moved to the spaced position.

The driver 63*h* is also responsive to the driving signal DRA, and produces a pulse signal PWMA with variable duty ratio in the presence of the driving signal DRA. The driving signal DRA contains a piece of data information indicative of the duty ratio, and the driver 63*h* tailors the pulse signal PWMA in accordance with the piece of data information. Namely, if the actual position of the plunger 61*b* and, accordingly, the bracket member 63*a* are lower than the target position designated by the digital volume signal VOL, the controller 63*g* changes the piece of data information for increasing the duty ratio of the pulse signal PWMA, and the driver 63*h* increases the duty ratio of the pulse signal PWMA. The solenoid unit 61*a* increases the magneto-electric force, and the plunger 61*b* further projects from the solenoid unit 61*a* against elastic force of a return spring (not shown). On the other hand, if the plunger 61*b* is too high, the controller 63*g* instructs the driver 63*h* to decrease the duty ratio of the pulse signal PWMA, and the return spring retracts the plunger 61*b* due to the decreased electromagnetic force. Thus, the feedback loop consisting of the photo-interrupter 63*c* associated with the gray scale 63*b*, the signal processing unit 63*d*, the controller 63*g* associated with the volume switch 63*f* and the driver 63*h* regulates the plunger 61*b* and, accordingly, the pedal sub-rod 62*b* to the target position corresponding to the volume indicated by the digital volume signal VOL. In this instance, the bracket member 63*a*, the gray scale 63*b*, the photo-interrupter 63*c*, the signal processing unit 63*d*, the controller 63*g*, the volume switch 63*f*, the drivers 63*i* and 63*h*, the solenoid operated actuator 63*j* and the stopper 63*n* form in combination a mute lock system.

Figure 18:
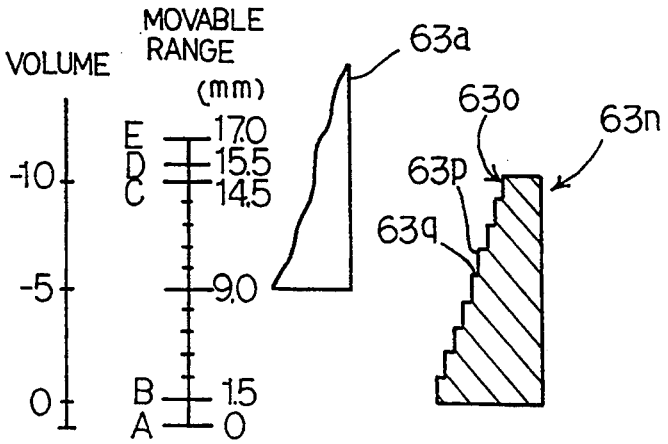
FIG. 18 is a view showing relation between a volume switch and a bracket member incorporated in the still another automatic player piano.

FIG. 18 shows a movable range of the plunger 61*b* and, accordingly, bracket member 63*a*, the target volume indicated by the digital volume signal VOL and the stopper 63*n*. In this instance, the pedal sub-rod 62*b* is movable from a free position A at zero millimeter to the highest position E at 17 millimeter, and the bottom surface of the bracket member 63*a* is illustrated together with the scale indicative of the movable range of the pedal sub-rod 62*b*. While the soft pedal 26*b* is released, the pedal sub-rod 62*b* remains in the free position A at zero millimeter. However, when the player fully steps on the soft pedal 26*b*, the pedal sub-rod 62*b* is upwardly moved to the highest position E. The movable range has intermediate positions B to D, and are corresponding to respective positions between zero to 17.0 millimeter.

The volume switch 63*f* is adjustable to an arbitrary value ranging from a standard volume through zero corresponding to the intermediate position B to negative value −10 to corresponding to the intermediate position C. However, the negative value −10 may be corresponding to the intermediate position D at 15.5 millimeters. The steps of the stopper 63*n* are arranged in such a manner as to correspond to the intermediate positions indicated by the values between zero to −10, and the stopper 63*n* keeps the bracket member 63*a* and, accordingly, the pedal sub-rod 62*b* at any intermediate positions corresponding to the value between zero to −10.

Figure 19:
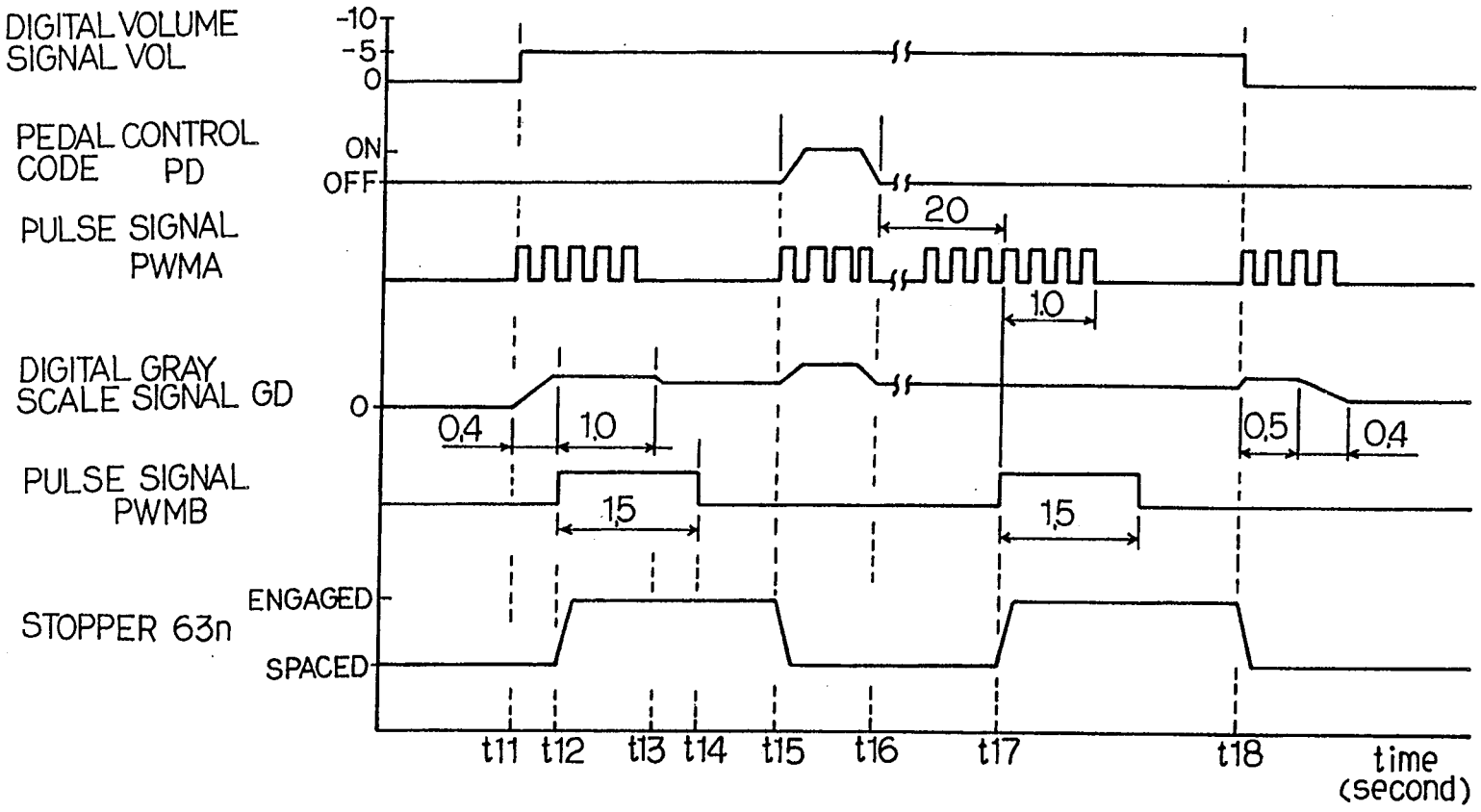
FIG. 19 is a time chart showing the control sequence of the still another automatic player piano.
Figure 20A:
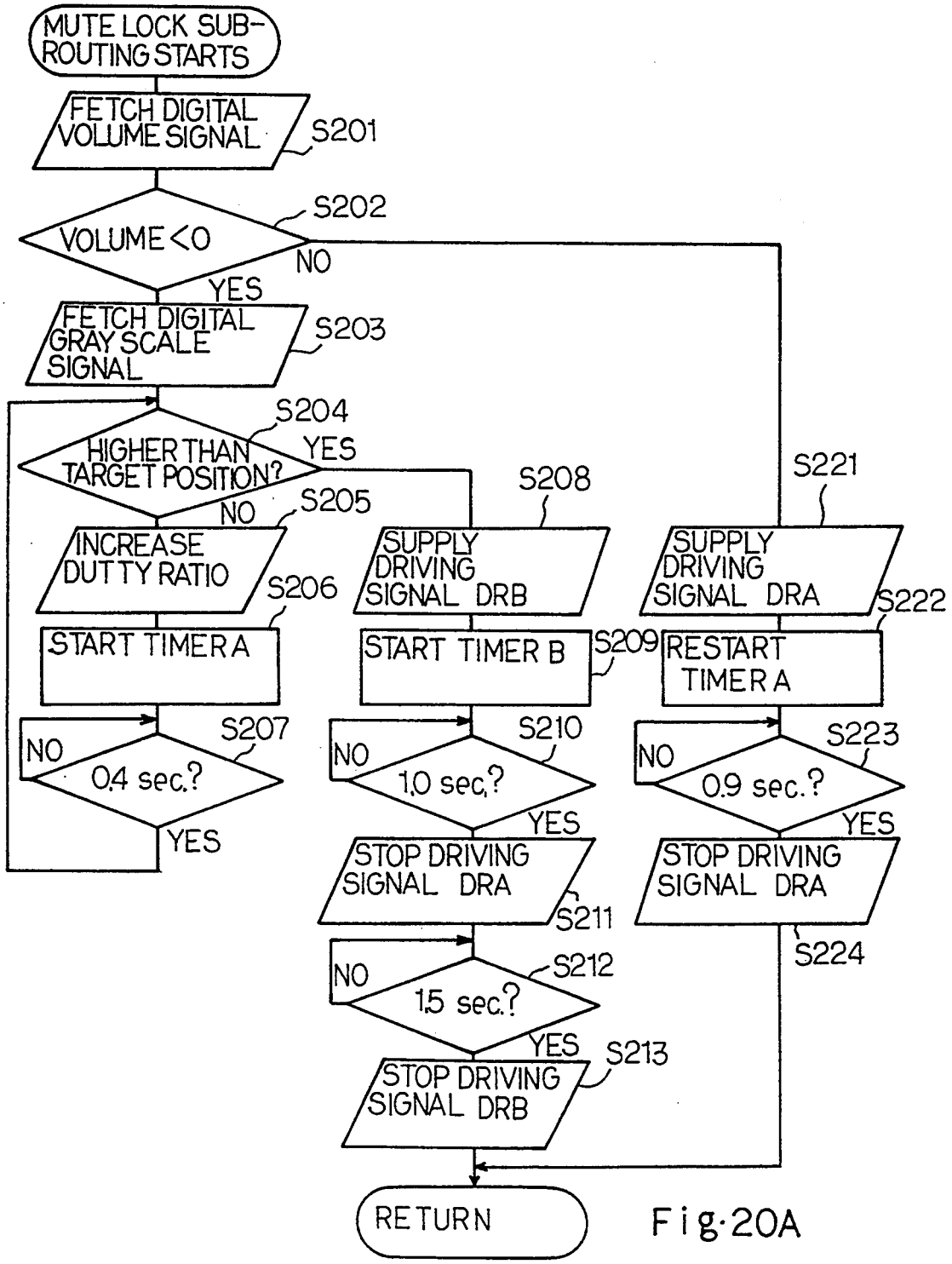
FIGS. 20A and 20B are flow charts showing a program sequence executed by a controller incorporated in the still another automatic player piano.
Figure 20B:
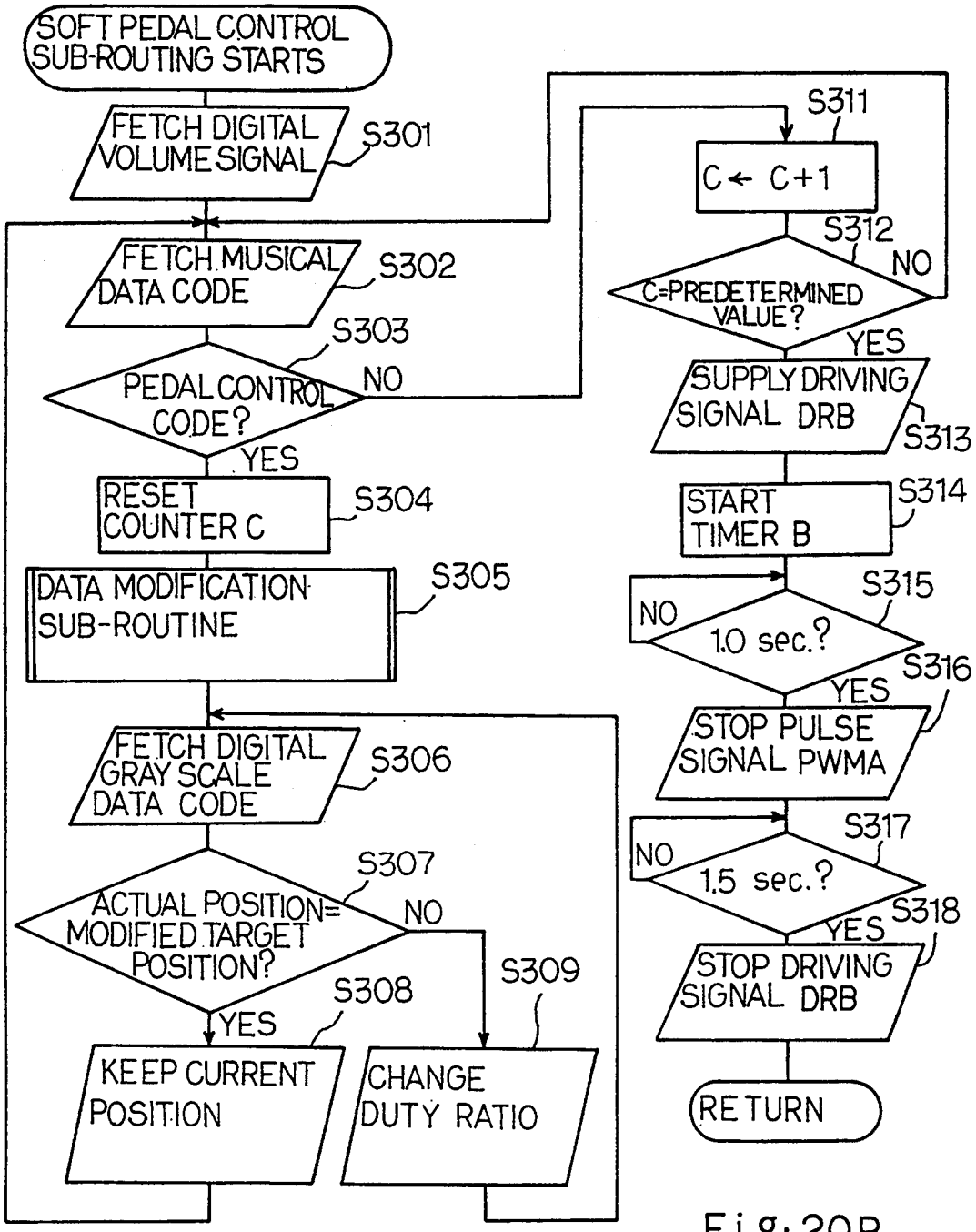

Turning to FIG. 19 of the drawings, a control sequence of the automatic player piano is illustrated, and the control sequence is supervised by the controller 63*g* operative to execute a program sequence shown in FIGS. 20A and 20B. Assuming now that the volume switch 63*f* is adjusted to −5 at time t11 of FIG. 19, the controller 63*g* starts on executing a lock sub-routine shown in FIG. 20A. The controller 63*g* proceeds to step S201, and fetches the digital volume signal VOL as by step S201. The controller 63*g* checks the digital volume signal VOL to see whether or not the selected volume is less than zero as by step S202. If the answer to step S202 is given affirmative, the controller 63*g* acknowledges a request for mute, and fetches the digital gray scale data signal GD as by step S203. The controller 63*g* compares the actual position indicated by the digital gray scale signal GD with the target position corresponding to the selected volume to see whether or not the actual position is higher than the target position as by step S204. If the plunger 61*b* is retracted into the solenoid unit 61*a*, the actual position is lower than the target position, and the answer to step S204 is given negative. With the negative answer, the controller 63*g* proceeds to step S205, and instructs the driver 63*h* to increase the duty ratio of the pulse signal PWMA. The controller 63*g* starts a timer A incrementing time as by step S206, and monitors the timer A to see whether or not the timer A reaches 0.4 second as by step S207. While the timer A increments the time toward 0.4 second, the solenoid unit 61*a* lifts the plunger 61*b* with the pulse signal PWMA. When 0.4 second is expired, the answer to step S207 is given affirmative, and the control sequence of FIG. 19 reaches time t12. However, the control sequence illustrates on the assumption that the loop consisting of steps S204 to 207 is not repeated. With the affirmative answer, the controller returns to step S204, and reiterates the loop consisting of steps S204 to S207 until the answer to step S204 is changed to affirmative.

When the answer to step S204 becomes affirmative, the bottom surface of the bracket member 63*a* becomes slightly higher than the target position, and the controller 63*g* supplies the driving signal DRB to the driver 63*i* as by step S208. Then, the pulse signal PWMB is supplied to the solenoid operated actuator 63*j*, and the controller 63*g* starts a timer B incrementing time as by step S209. The controller 63*g* monitors the timer B to see whether or not the timer B reaches 1.0 second as by step S210. While the timer B increments the time toward 1.0 second, the plunger 63*m* moves the stopper 63*n* to the engageable position, and the side surface 63*p* (see FIG. 18) is brought into abutting engagement with the bracket member 63*a*. The control sequence of FIG. 19 reaches time t13.

When 1.0 second is expired, the answer to step S210 is given affirmative, and the controller 63*g* stops the driving signal DRA as by step S211. The controller 63*g* monitors the timer B to see whether or not the timer B reaches 1.5 seconds as by step S212. While the timer B increments the time to 1.5 seconds, the return spring of the actuator 61 retracts the plunger 61*b*, and the bracket member 63*a* is brought into contact with the step 63*q* of the stopper 63*n* (see FIG. 18). When the 1.5 seconds is expired, the answer to step S212 is given affirmative, and the controller 63*g* stops the driving signal DRB as by step S213. Then, the solenoid operated actuator 63*j* is deenergized in the absence of the pulse signal PWMB, and the control sequence reaches time t14. However, the bracket member 63*a* is held in contact with the stopper 63*n* due to the friction therebetween.

When the automatic player piano enters a playback mode of operation, the controller 63*g* executes a soft pedal control sub-routine shown in FIG. 20B. The controller 63*g* fetches the digital volume signal VOL as by step S301, and stores the value indicative of the selected volume in an internal memory thereof. The controller 63*g* further fetches a musical data code just retrieved as by step S302, and checks the musical data code to see whether or not the musical data code is a pedal control code PD as by step S303. If the musical data code is the pedal control code PD, the answer to step S303 is given affirmative, and the controller 63*g* resets a counter C as by step S304. Step S302 corresponds to time t15 of FIG. 19.

After step S304, the controller 63*g* executes a data modification sub-routine S305. In detail, the pedal control data PD contains a piece of data information indicative of a target position of the bracket member 63*a*. The target position is determined on the assumption that any mute is not requested. If the selected volume is greater than zero, the stopper 63*n* does not restrict the motion of the bracket member 63*a*, the pedal control code is available without any modification. However, the selected volume is not greater than −1, the movable range of the bracket member 63*a* is shrunk, and the pedal control code PD is not appropriately indicative of the target position. For example, if the pedal control code PD is indicative of a target position lower than the position where the bracket member 63*a* is held in contact with the stopper 63*n*, the pedal control code PD is ignored. In order to avoid such undesirable situation, the pedal control code PD should be modified depending upon the position where the bracket member 63*a* is held in contact with the stopper 63*n*.

In the data modification sub-routine S305, the ordinary movable range between zero to 17 millimeters is shrunk to a modified movable range, and the lowest limit at zero is changed to the position where the bracket member 63*a* is held in contact with the stopper 63*n*. Such a compression is achieved through various methods. One of the easiest method is multiplication using a ratio between the ordinary variable range and the modified variable range as a multiplier. After the modification, the target position is referred to as "modified target position".

If the data modification sub-routine S305 is completed, the controller 63*g* fetches the digital gray scale signal GD indicative of the actual position of the bracket member 63*a* as by step S306, and compares the actual position of the bracket member 63*a* with the modified target position to see whether or not the actual position is matched with the modified target position as by step S307. If the actual position is matched with the modified target position, the answer to step S307 is given affirmative, and the controller 63g instructs the driver 63h to maintain the duty ratio of the pulse signal PWMA for keeping the current position as by step S308. After step S308, the controller 63g returns to step S302.

On the other hand, if the answer to step S307 is given negative, the controller proceeds to step S309, and instructs the driver 63h to change the duty ratio of the pulse signal PWMA. Thereafter, the controller 63g returns to step S306, and reiterates the loop consisting of steps S306, S307 and S309 until the actual position is matched with the modified target position. When the actual position is matched with the modified target position, the answer to step S307 is given affirmative, and the controller returns to step S302 through step S308. Thus, the solenoid operated actuator 61 changes the bracket member 63a within the modified movable range, and the automatic player piano faithfully performs a music.

The musical data codes are not of the pedal control code at all times. If the controller 63g decides that the fetched musical data code is not a pedal control code, the answer to step S303 is given negative, and the controller 63g proceeds to step S311 so as to increment the counter C. The controller 63g checks the counter C to see whether or not the value stored in the counter C is equal to a predetermined value as by step S312. The predetermined value is equivalent to 20 seconds between time t16 and time t17 in this instance. If the answer to step S312 is given negative, the controller 63g returns to step S302, and fetches a new musical data code. However, if the answer to step S312 is given affirmative, the controller 63g instructs the driver 63i to supply the pulse signal PWMB to the solenoid operated actuator 63j as by step S313, and restarts the timer B incrementing the time stored therein as by step S314. Thereafter, the controller 63g monitors the timer B to see whether or not the timer B reaches 1.0 second as by step S315. While the timer B increments the time toward 1.0 second, the plunger 63m is advanced, and the stopper 63n is brought into contact with the bracket member 63a. The control sequence of FIG. 19 teaches that the pedal control code PD is never retrieved over 20 seconds between time t16 and time t17.

With the affirmative answer to step S315, the controller 63g instructs the driver 63h to stop the pulse signal PWMA as by step S316, and monitors the timer B to see whether or not the timer B reaches 1.5 seconds as by step S317. While the timer B increments the time toward 1.5 seconds, the return spring of the actuator 61 allows the plunger 61b to downwardly moved, and the bracket member 63a is brought into contact with the stopper 63n. When the timer B reaches 1.5 seconds, the answer to step S317 is given affirmative, and the controller 63g instructs the driver 63i to stop the pulse signal PWMB as by step S318. However, the stopper 63a is held in contact with the bracket member 63a due to the friction therebetween. Thus, if a new pedal control code is not retrieved over the predetermined time period, the controller 63g allows the stopper 63n to be held in contact with the bracket member 63a, thereby preventing the solenoid operated actuators 61 and 63j from undesirable overheat.

If the volume switch is changed to zero at time t18 of FIG. 19, the answer to step S202 of FIG. 20A is given negative, and the controller instructs the driver 63h to supply the pulse signal PWMA to the solenoid operated actuator 61 as by step S221. The pulse signal PWMA causes the plunger 61b to project upwardly, and the controller 63g restarts the timer A incrementing the time held herein as by step S222. The controller 63g monitors the timer A to see whether or not the timer A reaches 0.9 second as by step S223. While the timer A increments the time towards 0.9 second, the bracket member 63a upwardly spaced from the stopper 63n. Since the pulse signal PWMB is not supplied to the solenoid operated actuator 63j, the return spring of the actuator 63j retracts the plunger 63m into the solenoid unit 63k, and the stopper 63n is moved to the spaced position. When the timer A counts 0.9 second, the answer to step S223 is given affirmative, and the controller instructs the driver 63h to stop the pulse signal PWMA. Then, the return spring of the actuator 61 retracts the plunger 61b into the solenoid unit 61b.

As will be appreciated from the foregoing description, the automatic player piano according to the present invention can control the loudness even if the hammer rail is moved to a mute position, and a music is faithfully performed in small volume.

Although particular embodiments of the present invention have been shown and described, it will be obvious to those skilled in the art that various changes and modifications may be made without departing from the spirit and scope of the present invention. For example, the mechanical components may correspond to those of a grand piano, and the controller may be of a separate type.

What is claimed is:

1. An automatic player piano comprising:

a) a keyboard having a plurality of keys each swingable when depressed by a player;

b) a plurality of key action mechanisms respectively coupled with said keys, and moving when the player depresses the associated keys;

c) a plurality of hammer mechanisms respectively coupled with said plurality of key action mechanisms, and having respective hammers selectively driven by the associated key action mechanisms for striking associated music wires, and a hammer rail causing said hammers to move between a closer position to said associated music wires and a spaced position from said associated music wires;

d) a soft pedal mechanism having a soft pedal depressed by said player, and a pedal mechanism responsive to motion of said soft pedal and operative to drive said hammer rail for causing said hammers to move to said closer position;

e) a playback means operative to cause said hammer mechanisms to selectively strike said associated music wires for reproducing sounds without said player;

f) an actuator selectively entering a first state and a second state, and operative to drive said pedal mechanism for causing said hammers to move between said closer position and said spaced position; and g) a mute lock means provided in association with said actuator, and operative to keep said actuator in said second state for keeping said hammers in said closer position, said mute lock means comprising:

g-1) a bracket fixed to said pedal mechanism and movable together with said pedal mechanism, g-2) a claw member movable between an engageable position with said bracket and a spaced position without engagement with said bracket, and g-3) a mute lock actuator coupled with said claw member for driving between said engageable position and said spaced position.

2. An automatic player piano as set forth in claim 1, in which said actuator is gradually varied between said first state and said second state, and is capable to staying any one of intermediate states between said first state and said second state.

3. An automatic player piano as set forth in claim 2, in which said mute lock means further comprises g-4) a volume switch manipulated by an operator for producing a volume signal indicative of a target position, g-5) a detector operative to monitor said actuator for producing a positional data signal indicative of an actual position between said first state and said second state, g-6) a controller operative to compare said actual position with said target position, and producing a first driving signal for indicating a duty ratio of a first pulse signal and a second driving signal for a second pulse signal, g-7) a first driver responsive to said first driving signal, and operative to tailor said first pulse signal supplied to said actuator, thereby allowing said actuator to enter any one of said first and second states and said plurality of intermediate states, and g-8) a second driver responsive to said second driving signal, and operative to supply said second pulse signal to said mute lock actuator.

4. An automatic player piano as set forth in claim 3, in which said controller modifies a target position indicated by a pedal control code sequentially retrieved for a music when said claw member is held in contact with said bracket at any one of said plurality of intermediate states.

* * * * *